US005891521A

United States Patent [19]

Marumoto et al.

[11] Patent Number: 5,891,521

[45] Date of Patent: Apr. 6, 1999

[54] METHOD OF PAINTING CUT EDGE OF PRECOATED STEEL SHEET AND PAINTING APPARATUS FOR SAME

[75] Inventors: Seiichi Marumoto; Ryoji Nishioka; Kohei Ueda; Yukihisa Kuriyama, all of Futtsu, Japan

[73] Assignee: Nippon Steel Corporation, Tokyo, Japan

[21] Appl. No.: 11,582

[22] PCT Filed: Sep. 6, 1996

[86] PCT No.: PCT/JP96/02550

§ 371 Date: Mar. 6, 1998

§ 102(e) Date: Mar. 6, 1998

[87] PCT Pub. No.: WO97/09128

PCT Pub. Date: Mar. 13, 1997

[30] Foreign Application Priority Data

| | | | |
|---|---|---|---|
| Sep. 7, 1995 | [JP] | Japan | 7-230232 |
| Sep. 7, 1995 | [JP] | Japan | 7-230551 |
| Nov. 9, 1995 | [JP] | Japan | 7-291528 |
| Apr. 12, 1996 | [JP] | Japan | 8-114318 |
| Apr. 19, 1996 | [JP] | Japan | 8-120868 |

[51] Int. Cl.[6] ..... B05G 1/28; B05G 1/32; B05C 1/06; B05C 1/16

[52] U.S. Cl. ..... 427/282; 427/284; 427/287; 427/429; 118/264; 118/266; 118/505

[58] Field of Search ..... 427/284, 429, 427/282, 287, 348; 118/264, 266, 505

[56] References Cited

U.S. PATENT DOCUMENTS 3,947,614 3/1976 Becker ..... 427/284

FOREIGN PATENT DOCUMENTS 83109800 10/1994 China .
7-117012 5/1995 Japan .

*Primary Examiner*—Katherine A. Bareford
*Attorney, Agent, or Firm*—Kenyon & Kenyon

[57] ABSTRACT

A method and apparatus for painting all or part of a cut edge of a precoated steel sheet or its shaped article to which a masking film is attached, wherein a painting pad comprised of a sponge or nonwoven fabric and/or woven fabric is impregnated with a paint, the surface of the painting pad is wiped with gas to remove the excess paint, then the painting pad is pressed against the cut edge of the precoated steel sheet under force control.

25 Claims, 21 Drawing Sheets

METHOD OF PAINTING CUT EDGE OF PRECOATED STEEL SHEET AND PAINTING APPARATUS FOR SAME

This is a national stage application of PCT/JP96/02550, filed Sep. 6, 1996.

TECHNICAL FIELD

The present invention relates to an improvement in a method and apparatus for painting (or corrosion-proofing) the cut edge (or end edge) of a precoated steel sheet cut to the final dimensions of the finished product or a processed article thereof (hereinafter sometimes referred to simply as a "precoated steel sheet" or "precoated steel") used for the production of a product of a construction using a precoated steel sheet for its exterior plate such as electrical products, furnitures, building materials, and auto parts.

BACKGROUND ART

Consumer goods such as electrical products, furnitures, building materials, auto parts, are being reassessed as to the steel sheet used in their external structures from the viewpoint of recycling, elimination of harmful substances in waste disposal, and the ecology. Further, even among the steel sheets used, ferrous metal manufacturers are painting the outer surface of the steel sheet with the paint of the final product and using this as starting material. Therefore, the precoated steel sheet is being viewed with interest as being capable of eliminating the painting step at the manufacturer of the final product.

The problem with using such a precoated steel sheet as an outer plate is that, when cutting the precoated steel sheet to the final dimensions of the finished product, the cut edge becomes a bare ferrous metal having no paint or plating. Therefore, for products which are to be used in environments requiring rust-proofing (even products used in normal indoor environments often require rust-proofing at portions exposed at the outside in view of the image of the product) and products where the strange feeling given by the color of the paint of the precoated steel sheet and the metallic luster of the cut edge would detract from the image of the product, one either has to give up on the use of a precoated steel sheet (use an ordinary steel sheet and paint it after processing) or else paint the cut edge after the processing.

Note that in the case of such post-painting of the cut edge, it is necessary to prevent the paint from spreading to the decorative surface of the precoated steel sheet so as to protect the beauty of the decorative surface. However, the thickness of the steel sheet used here is about 1 mm or an extremely thin steel sheet of even less than 1 mm. Painting such a thickness of a cut edge without spreading over to the decorative surface is extremely difficult even using various manual painting methods such as spray painting or roller painting—it is close to impossible to perform by automatic painting machines.

In the past, the technique known as "masking" is used to deal with this problem. For example, as shown in FIG. 1, the portion on the precoated steel sheet 1, on which spreading of paint was desired to be prevented, was covered in advance by masking tape 2 along the surface to be painted, the painting was conducted in that state, then the tape was peeled off after painting. Thus the beautiful painting free from spreading to the surface to be protected can be obtained. By masking in this way, various methods of painting were possible. However, when attaching the masking tape, it is necessary to attach the tape exactly along the complicated contour of the processed surface of the product. This could only be done by careful manual work by workers and was therefore a costly, time-consuming technique.

As a prior art relating to coating of a chemical on to the end edge of a plate material, while differing in the field of art, Japanese Unexamined Patent Publication (Kokai) No. 5-263271 has proposed a technique of coating a photoresist on to the end edge of a lead frame plate.

However, in the protective painting of the cut edge of a precoated steel sheet to which the present invention is concerned, it is most preferred from the perspectives of the cost of the painting and the beauty of the exterior appearance that only the cut edge and its surroundings be painted, and therefore, the spray painting of the above prior art is not suitable for the protective painting of the cut edge of a precoated steel sheet even assuming masking.

Further, in the case of simple roller painting, the cut edge of the steel sheet near the knife edge, where in general even burrs remain, is painted, and therefore, there is the problem of easy damage to the roller. On top of this, the portion of contact becomes the point contact of the painting roller and the cut edge of the steel sheet and therefore, the actual contact area becomes small. Accordingly, a large fluctuation in the contact force of the painted portion per unit area unavoidably occurs. In particular, in the case of thick painting providing a thickness of several tens of microns so as to cover burrs on the cut edge, it is difficult to paint uniformly and stably.

Further, the prior art of coating a chemical on to the end edge of a plate material disclosed in Japanese Unexamined Patent Publication (Kokai) No. 5-263271 describes an invention for coating a resist on the end edge of a lead frame plate. Not only does the field of art differ, but when making a painting device held by, for example, a robot and using the motion of the robot to perform the painting as in the present invention and, when the portion to be painted is an open end edge, the application thereof becomes difficult. Accordingly, improvement of the method and apparatus of painting and rust-proofing the cut edge or end edge of a precoated steel sheet has been desired.

Further, the decisive point in using a precoated steel sheet as an exterior plate is that shaping giving a large deformation easily causes damage to the coating of the precoated steel sheet at the portion coming into contact with the shaping die, when shaping the original precoated steel sheet. Therefore, when shaping a product to a large extent, the practice has been to attach to one or both surfaces of the original precoated steel sheet a plastic film serving as both a lubricating film and protective film at the time of shaping by the die.

The plastic film which is attached, however, has to be removed after the shaping or after the assembly of the product (almost always manually peeled off by workers). Considering the work efficiency at this time, it is not possible to adhere the plastic film too strongly to the precoated steel sheet.

In recent years, the quality of steel sheet and coatings have been improved and it has become possible to perform the shaping of the steel sheet even with major deformation, but in products making use of this feature, in particular when performing sophisticated shaping in several steps, if performing the first shaping, then, for example, peeling off the adhered plastic film, as partially shown in FIG. 20 and FIG. 25 explained below, and performing the next shaping step in that state, the plastic film portion wrinkles and is printed on the product and thereby becomes a cause detracting from the appearance of the product and a cause of flaws in the expensive die. Accordingly, improvements have been sought in the method for attaching a plastic film to a precoated steel sheet capable of preventing flaws in the painted surface at the time of shaping a product of a structure using a precoated steel sheet for the exterior plate.

DISCLOSURE OF THE INVENTION

Accordingly, the object of the present invention is to provide a method and apparatus for painting the cut edge (or end edge) of a precoated steel sheet or the processed article thereof wherein the cut edge of the precoated steel sheet or the processed article thereof can be painted at a low cost, with a high efficiency, and with a high quality, without the paint spreading to the precoated surface.

Another object of the present invention is to provide a method and apparatus for painting the cut edge (or end edge) of a precoated steel sheet where the cut edge of the precoated steel sheet can be painted with a thickness of several tens of microns, at a low cost, and with a high efficiency capable of providing a high quality local painting of a uniform thickness.

Another object of the present invention is to provide a method for painting the cut edge of a precoated steel sheet or the processed shaped article thereof capable of providing reliable paint protection of the precoated steel sheet at the time of shaping the steel sheet with a high degree of processing, not causing shaping flaws in the paint of the precoated surface, and enabling low cost, high efficiency sophisticated shaping.

In accordance with the present invention, there is provided a method for painting a cut edge of a precoated steel sheet or the processed article thereof to which a masking film is attached, comprising impregnating a painting pad composed of a sponge or a nonwoven and/or woven fabric with a paint, followed by wiping, the surface of the painting pad with a gas to remove the excess paint on or in the painting pad, then pressing the painting pad against the cut edge of the precoated steel sheet under force control.

In accordance with the present invention, there is also provided a painting apparatus for painting the cut edge of a precoated steel sheet or the processed article thereof to which a masking film is attached, comprising a painting pad composed of a sponge or a nonwoven and/or woven fabric, a mechanism for impregnating the painting pad with a paint and/or for pressure feeding and soaking a paint to the inside surface of the paint pad, a mechanism for wiping the excess paint on or in the surface of the painting pad with a gas (i.e., gas knife), and a mechanism for pressing the painting pad against the cut edge under force control.

BRIEF DESCRIPTION OF THE DRAWINGS

The present invention will be explained in further detail below while referring to the drawings, wherein.

BEST MODE FOR CARRYING OUT THE INVENTION

Figure 1:
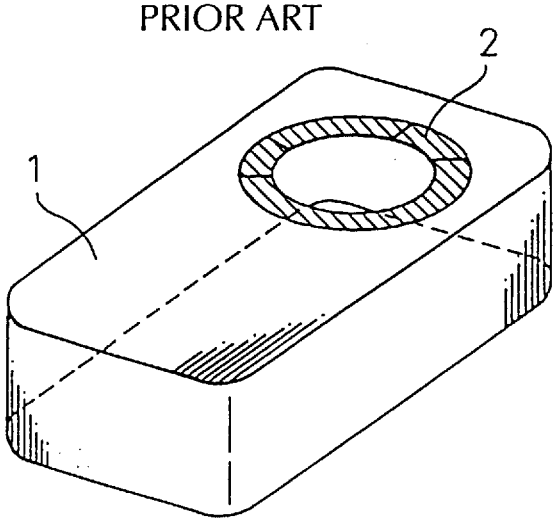
FIG. 1 PRIOR ART
FIG. 1 is an explanatory view of the method of masking and painting used in the prior art.

According to the present invention, to solve the above problems, the inventors found that to coat just the necessary amount of paint at just the necessary portions of a knife edge surface, the method and apparatus for pressing a painting pad by a stamping system on to the cut edge of the precoated steel sheet (or the processed article thereof) and controlling the amount of the paint held on the surface of the painting pad in the end by gas wiping (by wiping off by gas) and, further, for controlling the pressing force when pressing the painting pad to the cut edge of the precoated steel sheet (or the processed article thereof) to be painted so as to adjust the amount of the paint squeezed out from the painting pad were optimal for stabilization and standardization of the amount of paint coated to the cut edge of the precoated steel sheet (or the processed article thereof).

That is, the gist of the method of painting according to the present invention lies in:

(1) A method for painting a cut edge of a precoated steel sheet or the processed article thereof to which a masking film is attached, wherein a painting pad composed of a sponge or a nonwoven and/or woven fabric is impregnated with a paint, the surface of the painting pad is wiped with a gas (e.g., air $N_2$) to remove the excess paint on or in the surface of the painting pad, then the painting pad is pressed against the cut edge of the precoated steel sheet under force control.

(2) A method according to the above (1), wherein when pressing the painting pad against the cut edge under force control, at least two settings of the pressing force are provided and in the final painting step (pressing step just before painting pad is pulled away from the cut edge of the precoated steel sheet) the painting pad is pressed for a predetermined time by a setting of the pressing force smaller than the maximum pressing force.

(3) A method according to the above (1) or (2), wherein, when pressing the painting pad against the cut edge under the force control, the painting pad is pressed from a direction inclined by an inclination $\tan\theta = 1/100$ to $1/3$ from the direction perpendicular to the cut edge.

(4) A method according to any one of the above (1)–(3), wherein, after coating the paint to the cut edge of the precoated steel sheet by the painting pad and before drying or curing the coated paint, the paint coated on the cut edge is allowed to reflow using hot air to thereby smooth the coating on the cut edge.

(5) A method according to any one of the above (1)–(4), wherein the width of the painting pad is made the width necessary for several steps of pressing and painting and pressing and painting are performed several times while successively changing the position in the width direction of the painting pad with each application of paint to the painting pad.

The gist of the painting apparatus according to the present invention lies in:

(1) A painting apparatus for painting the cut edge of a precoated steel sheet or the processed article thereof to which a masking film is attached, comprising a painting pad comprised of a sponge or a nonwoven fabric and/or a woven fabric, a mechanism for impregnating the painting pad with a paint and/or for pressure feeding and soaking a paint to the inside surface of the painting pad, a mechanism for wiping the excess paint on or in the surface of the painting pad with a gas (i.e., gas knife), and a mechanism for pressing the painting pad against the cut edge under force control.

(2) An apparatus according to the above (1), wherein the painting pad is composed of a nonwoven fabric at the inside, a woven fabric which covers the outside of the nonwoven fabric at least at the surface coming into contact with the cut edge of the precoated steel sheet or the processed article thereof, and a rigid base to which the nonwoven fabric and the woven fabric are attached.

(3) An apparatus according to the above (1) or (2), wherein the mechanism for pressing the painting pad against the cut edge is made a pressing mechanism using a fluid pressure cylinder and the circuit of the fluid pressure cylinder is provided with a multistep pressure setting circuit capable of controlling the force pressing the painting pad during the pressing and painting.

(4) An apparatus according to the above (1) or (2), wherein the mechanism for pressing the painting pad against the cut edge of the precoated steel sheet is made a pressing mechanism using a mechanical spring mechanism composed of several stages connected in parallel and/or in series and the mechanical spring mechanism has a mechanism for changing the spring force in several stages by successively releasing the constraint of the spring force or reconstraining the same depending upon the stroke of movement between the painting pad and the holding device so as thereby to make the force pressing to the painting pad during the pressing and painting variable.

(5) An apparatus according to the above (1) or (2), wherein the mechanism for pressing the painting pad against the cut edge of the precoated steel sheet is made a combination of a pressing mechanism using a fluid pressure cylinder of the above apparatus (3) and a pressing mechanism using a mechanical spring mechanism of the above apparatus (4).

(6) An apparatus according to any one of the above (1)–(5), wherein the painting pad is made a rotatable construction and the rotation of the painting pad is constrained by a mechanical stopper when retracting the pressing mechanism.

(7) An apparatus according to the above (1), wherein the tension of the woven fabric at the outside of the painting pad is made adjustable by a screw.

According to the present invention, further, the plastic film attached for the protection of the painting surface of the precoated steel sheet for masking is effectively used. That is, the precoated steel sheet is shaped or cut in a state that the plastic film is attached to at least the surface of the precoated steel sheet, which becomes the front surface of the shaped article, then a part or all of the cut edge is painted, while the attached plastic film is used as the masking film.

Further, in the present invention, it is possible to use the plastic film attached to the surface of the precoated steel sheet, of which a plastic film is predivided and/or has a cut or perforations so as to allow the plastic film of the painting portion of the cut edge to be separated from the other portion of the plastic film and left. Further, it is possible, after the precoated steel sheet is shaped into the shape of the final product and before cutting the cut portion to finally remain in the product, to relax the local stress occurring in the attached plastic film at the time of shaping by heating and/or partial cuts in the plastic film. The plastic film may be attached to the surface of the precoated steel sheet only near the painting portion of the cut edge.

In the present invention, further, the plastic film may be attached not before shaping the precoated steel sheet to the shape of the final product, but before cutting the cut portion to finally remain at the product shaped from the precoated steel sheet and the location where the plastic film is attached may be made only near the painting portion of the cut edge so as to paint the cut edge of the precoated steel sheet or the processed article thereof.

In this embodiment of the present invention, since the painting of the final shaped article is performed on the precoated steel sheet in its flat form, by shaping the material, then cutting it to the predetermined dimensions, a painted (except at the cut edge) product having the final shape is produced. Therefore, by attaching a plastic film corresponding to a masking tape at the cutting locations before the final cutting, it is possible to form a plastic film having a masking shape exactly matching the final shape of the outer surface at the same time as the final cutting.

The plastic film used in the present invention differs in required functions (e.g., strength and elongation, resistance to chemicals, etc.) depending on the method of processing the product and the finished shape, and therefore, it is important to select a material in accordance with the required functions. For example, for a product which requires deep drawing, a plastic film must have a lubricating effect at the time of deep drawing and elongation of the plastic film is also required, and therefore, a soft polyvinyl chloride is preferably used. Further, when a paint using an organic solvent is used as the paint of the post-painting, a film material such as polypropylene or polyethylene which is superior in solvent resistance is selected in view of the chemical reactivity with the organic solvent used (even if not withstanding it completely, one which can withstand it for the time required for the painting is sufficient).

Normally, the plastic film is attached to only the single side of the front surface. This is because the painted surface corresponding to the final product is in general just the one side forming the front of the product (reverse side is often simply given a rust-proofing treatment without regard to design or color). Note that to paint the two sides or to prevent flaws during processing, if necessary a plastic film may be attached to the two sides of the precoated steel sheet. Further, when the role of the plastic film is mainly for masking for the painting of the cut edge and the portion desired to be masked is smaller than the area of the original precoated steel sheet, then it is also effective not to apply the plastic film to the entire material but to locally apply plastic film to only the portions requiring post-painting of the cut edge for the purpose of using the minimum necessary amount of masking film.

As to the timing for attaching the plastic film, since the original precoated steel sheet is made into a three-dimensionally complicated shape by the shaping and it is generally not easy to attach the plastic film after the shaping, the plastic film is preferably attached to the material before shaping, that is, in the flat state. By this, it becomes easy to selectively attach the plastic film as needed to one or both sides of the precoated steel sheet. Note that, when the number of locations of painting of the cut edge is small or when there would be tremendous damage to the plastic film due to the shaping etc. and therefore, it would be preferable to cover only the painting portion of the cut edge of the final product, the time for attaching the plastic film is preferably made before the cutting of the cut portion to be finally left at the shaped article shaped from the precoated steel sheet.

Note that, when the shaping strain is large, the shaping is divided into several stages, but some products are of a shape where wrinkling or peeling is unavoidable at part of the plastic film in the first steps of the process. In this case, if the shaping is continued, sometimes press marks are formed in the product, and therefore, it is preferable to continue with the shaping after removing the portions of the plastic film where the wrinkling or peeling occurred. The portions where wrinkling or peeling occur in the plastic film can be predicted in advance from experience or experiments, so as to facilitate separation of the portion of the plastic film desired to be left and portion of the plastic film which should be removed, it is effective to make perforations or cuts in the plastic film depending upon the type of shaping or the type of masking of the plastic film or use plastic films divided from the start.

When deformation is given to the plastic film by shaping or cutting before the final step of the precoated steel sheet and the residual stress or residual strain cause a danger of peeling of the plastic film at the portion requiring masking at the time of the post-painting, it is preferable that the local stress of the plastic film at the portion requiring masking be eased by softening and elongation by heating or release of the residual stress by partial cutting etc. before cutting the cut portion to be finally left in the shaped article. Due to this, it is possible to prevent peeling of the plastic film and to effectively perform the masking for during the post-painting.

The cutting and processing in the present invention does not include a cutting means such as laser cutting or plasma cutting in which the paint of the precoated steel sheet is burnt and damaged and means shearing, drilling, sawing, etc. by a straight edged blade or roundnose tool free from the fear of burning and damage of the paint. Note that, when cutting the shaped article to the product dimensions, it is necessary to consider the peeling of the plastic film attached to the surface depending on the method of cutting. In this case, by making the final cutting direction start from the side of the product on which the plastic film is attached, it is possible to prevent peeling of the plastic film from the cut portion and maintain close bonding.

Figure 17:
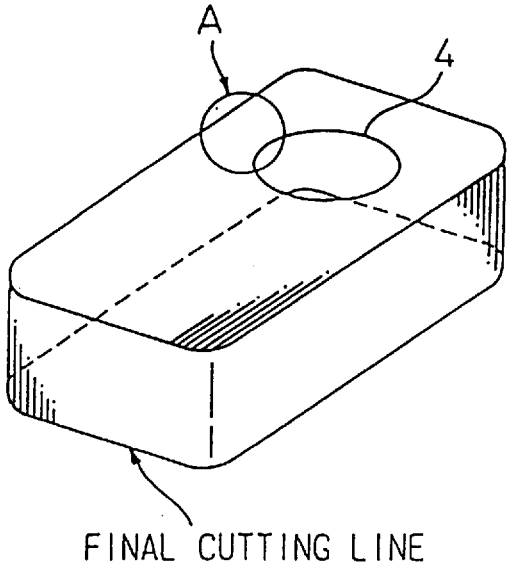
FIG. 17 is a view of an example of the product (part) after the painting of the cut edge in the present invention.

In the post-painting step, the ferrous metal of the cut edge exposed by the final cutting is painted, but as shown in FIG. 17, the plastic film performs the role of the masking tape, and therefore, the painting can be performed by ordinary painting without worrying about spreading. A paint and painting method suitable for the application of the product and the environment, for example, a painting method using spraying or brushing, a roller, dipping, etc. may be freely selected.

In the present invention, further, the change of the elongation due to temperature unique to the plastic film attached to the precoated steel sheet to protect its painted surface can be utilized. That is, in another embodiment of the present invention, it is possible to prevent flaws in the paint of the precoated steel sheet by hot forming the precoated steel sheet or the processed article thereof at a temperature of at least the softening temperature of the plastic film in a state with the plastic film attached to the outside surface or both surfaces thereof.

Peeling of the attached plastic film may be caused since the component force of the tension caused in the plastic film at the depressed portions exceeds the binding force of the plastic film at the time of drawing. To prevent this peeling, the only options are to increase the binding force or to reduce the tensile stress caused due to the shaping of the plastic film. If the binding force is strengthened, the trouble in peeling off the plastic film in the later stage becomes tremendous, and therefore, it is most preferable to reduce the tensile stress caused due to the shaping.

Figure 26:
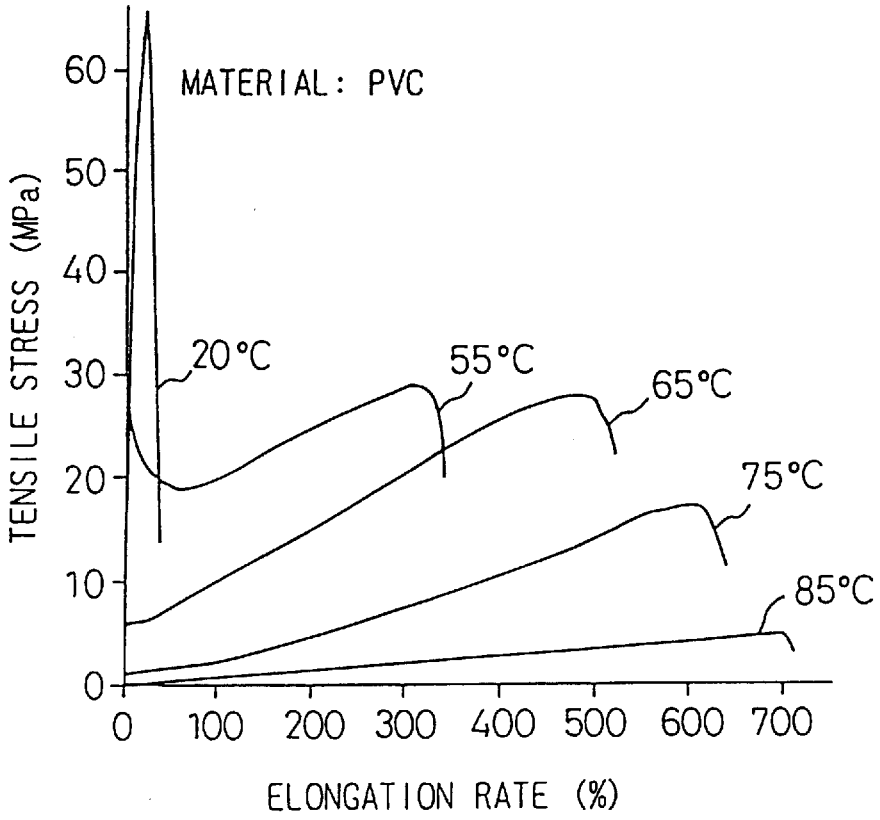
FIG. 26 is a view of an example of the tension-elongation-temperature characteristic of a plastic film (i.e., polyvinyl chloride) used in the present invention.

The plastic film usable in the present invention differs in required functions (e.g., strength and elongation, resistance to chemicals used in the manufacturing process, etc.) depending on the product being shaped, and therefore, the plastic material is suitably selected depending upon the required functions, but as typical examples polyvinyl chloride, polypropylene, and polyethylene is often used. The change in tensile properties of these plastics due to temperature was examined. The results are shown in FIG. 26 for polyvinyl chloride, in FIG. 27 for polypropylene, and in FIG. 28 for polyethylene. The effects of temperature on these materials, in particular the tensile stress, are shown together in FIG. 29.

As will be understood from these Figures, plastics have the property of rapidly increasing in elongation at a certain temperature (e.g., a temperature at most several tens of degrees centigrade below the melting point). That is, with the polyvinyl chloride of FIG. 26, when 55° C. is passed, the maximum tensile resistance is halved and the elongation rate rapidly increases.

Figure 27:
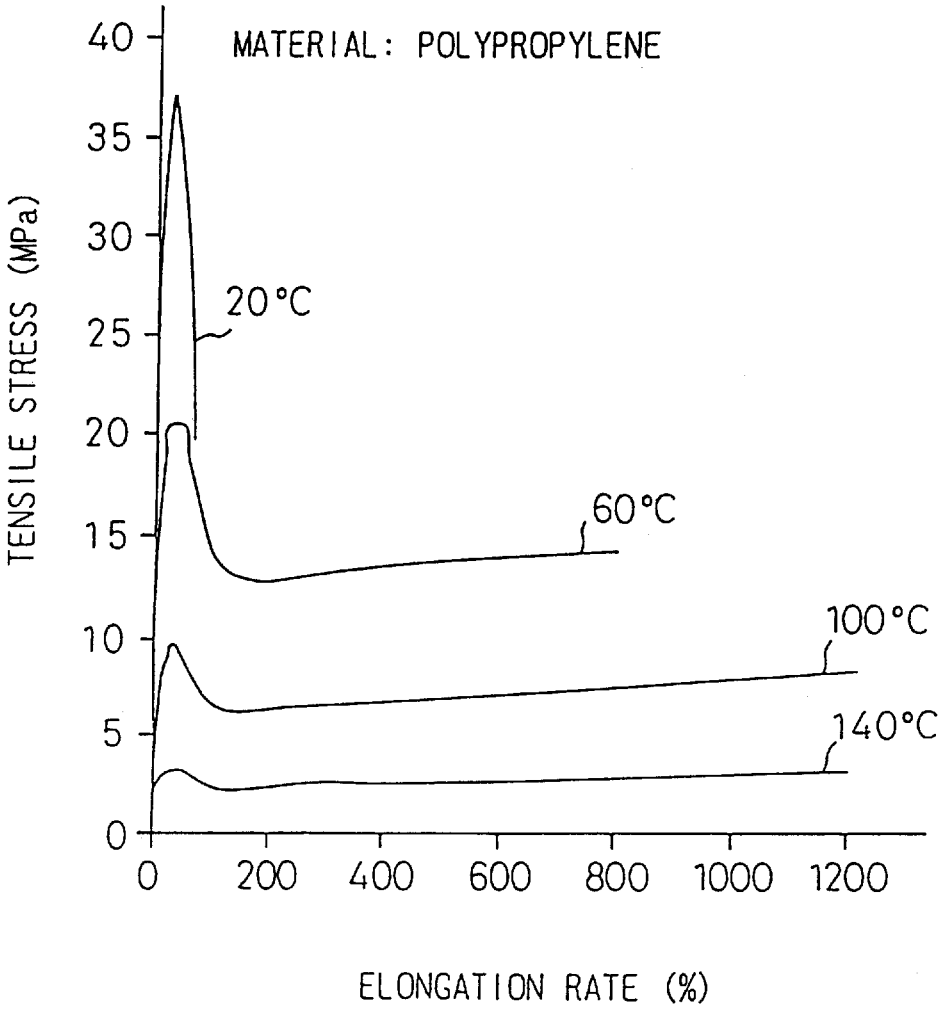
FIG. 27 is a view of an example of the tension-elongation-temperature characteristic of another plastic film (i.e., polypropylene) used in the present invention.
Figure 28:
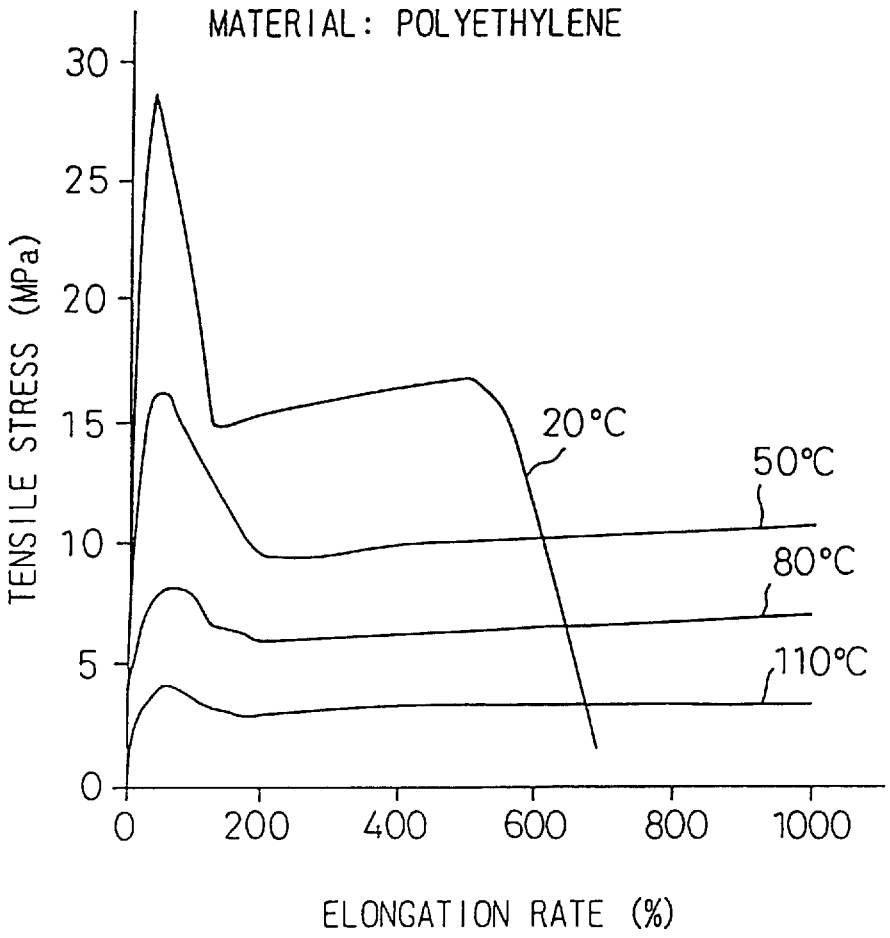
FIG. 28 is a view of an example of the tension-elongation-temperature characteristic of another plastic film (i.e., polyethylene) used in the present invention.
Figure 29:
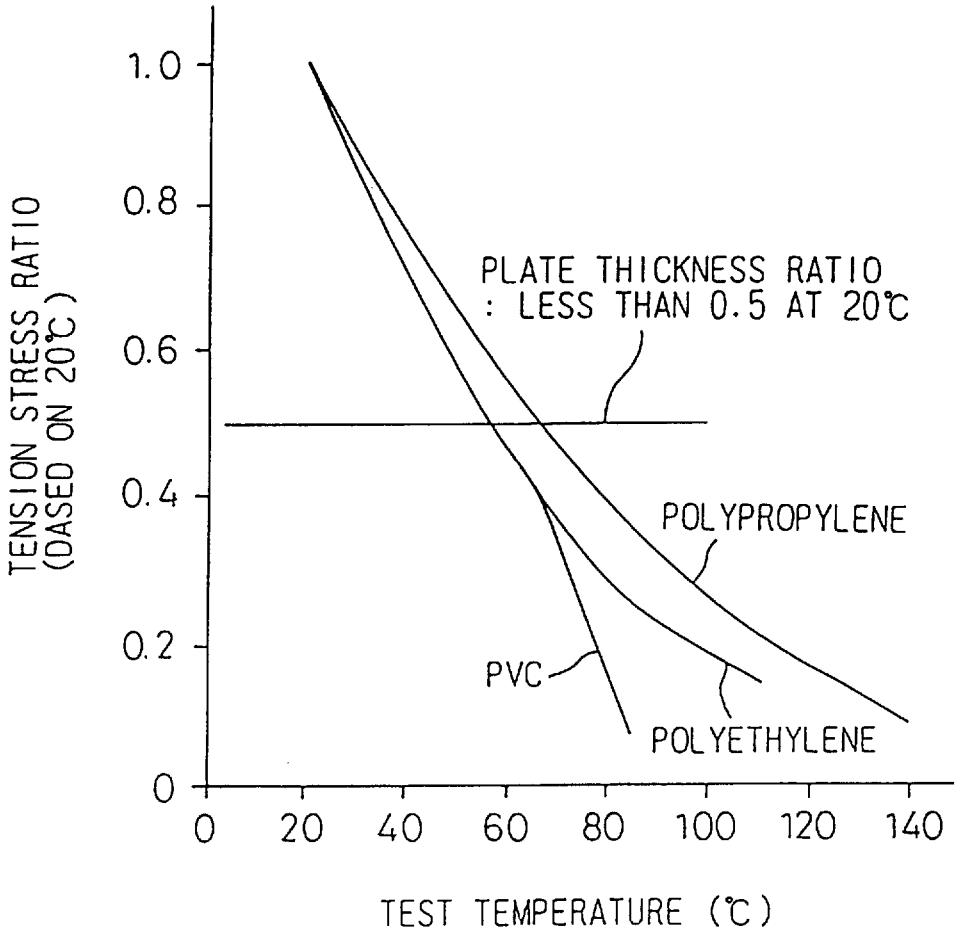
FIG. 29 is a view clarifying the tension-temperature characteristic in an example of a plastic film used in the present invention.

The polypropylene shown in FIG. 27 and the polyethylene shown in FIG. 28, though differing somewhat in the temperature at which these properties begin to be exhibited, have similar properties. In the present invention, note is taken of this property and the temperature showing the softening property where the tensile stress of the plastic film falls to less than half that of ordinary temperature (20° C.) and the elongation before break is at least 100% is defined as the softening temperature of the plastic film. That is, from FIG. 26 to FIG. 29, the softening temperature referred to in the present invention is 55° C. for polyvinyl chloride and polyethylene and 70° C. for polypropylene.

If this property is used, it becomes possible to easily cause deformation of the attached plastic film without causing damage to the paint of the precoated steel sheet or causing heat deformation harmful to the die by shaping near the softening temperature of the plastic film. By doing this, it is possible to perform a high degree of shaping, without causing at the time of processing peeling of the plastic film attached with a binding force low enough to enable peeling by hand, and therefore, it is possible to avoid flaws in the later shaping caused by the peeling and rising of the attached plastic film.

In particular, when the shaping strain is large, the shaping is divided into several stages. This embodiment has a large effect for products of a shape susceptible to wrinkling or peeling of part of the plastic film in the first step of the process.

Normally, the plastic film is attached to just the front surface. This is because the painted surface corresponding to the product is just the one side forming the front of the product (reverse side is often simply given a rust-proofing treatment, without regard to design or color).

Note that to paint the two sides or to prevent flaws during processing, if necessary, a plastic film may be attached to the two sides of the precoated steel sheet.

When the portion for which it is desired to prevent flaws in the painted surface is smaller than the area of the original precoated steel sheet, then it is also effective not to apply the plastic film to the entire material, but to locally apply plastic film to only the portions requiring it in view of the occurrence of shaping flaws for the purpose of using the minimum necessary amount of the plastic film.

According to the present invention, preferably the paint on the cut edge is cured in a short time without applying heat. In the case of a solvent based paint, time or heat was necessary to evaporate the solvent. If reducing the amount of the solvent in the paint in advance, the paint viscosity becomes higher and the painting efficiency ends up dropping. A paint which could hold a low viscosity even without a solvent and cured only the resin would enable curing in a short time.

Toward this end, the present inventors found that the cut edge (or the end edge) of the precoated steel sheet could be coated by a UV paint and UV light used to cure the coating.

This UV paint preferably has added to it not more than 2% by weight of a coloring pigment to prevent the metallic luster of the cut edge. That is, in a preferable embodiment of the present invention, the cut edge exposed by the shearing of the precoated steel sheet is coated with a UV curing paint. A UV curing paint has a low viscosity even without a solvent and if a clear resin with a high UV transmittance cures in several seconds, and therefore, the efficiency of the manufacturing process of the product becomes better. Further, since it is sufficient to use a UV lamp as the source of the UV light and irradiate just the cut edge of the painted steel sheet, the cost is lower than with a large heating furnace. Since no organic solvent is used, the method is environmentally friendly as well. As the clear resin usable as the UV curing paint, acrylic resins such as an acrylate, epoxy acrylate, urethane acrylate, polyester acrylate may be used.

When desiring to prevent the metallic luster at the cut edge, a coloring pigment is added. A UV curing paint, if colored, falls in the rate of transmittance of the UV rays and takes longer to cure. However, normally the precoated steel sheet is a thin plate having a thickness of 2 mm or less. There is no need to apply a deep color to paint such a cut edge. Therefore, if the amount of the pigment added, when coloring, is a small amount of 2% by weight or less, it is possible to keep the curing time short and eliminate the feeling of the metallic luster. As the coloring pigment, carbon black for black, titanium oxide for white, phthalocyanine blue for bluer and other coloring pigments used for paints may be used. Further, the paint may have added to it phthalocyanine for blue, aniline black for black, azos for red, and other pigments for coloring.

The method of coating the UV curing paint may be any coating method normally used. The coating method may be freely selected depending upon the application of the product or the environment, for example, from spray coating or brush coating.

Figure 30:
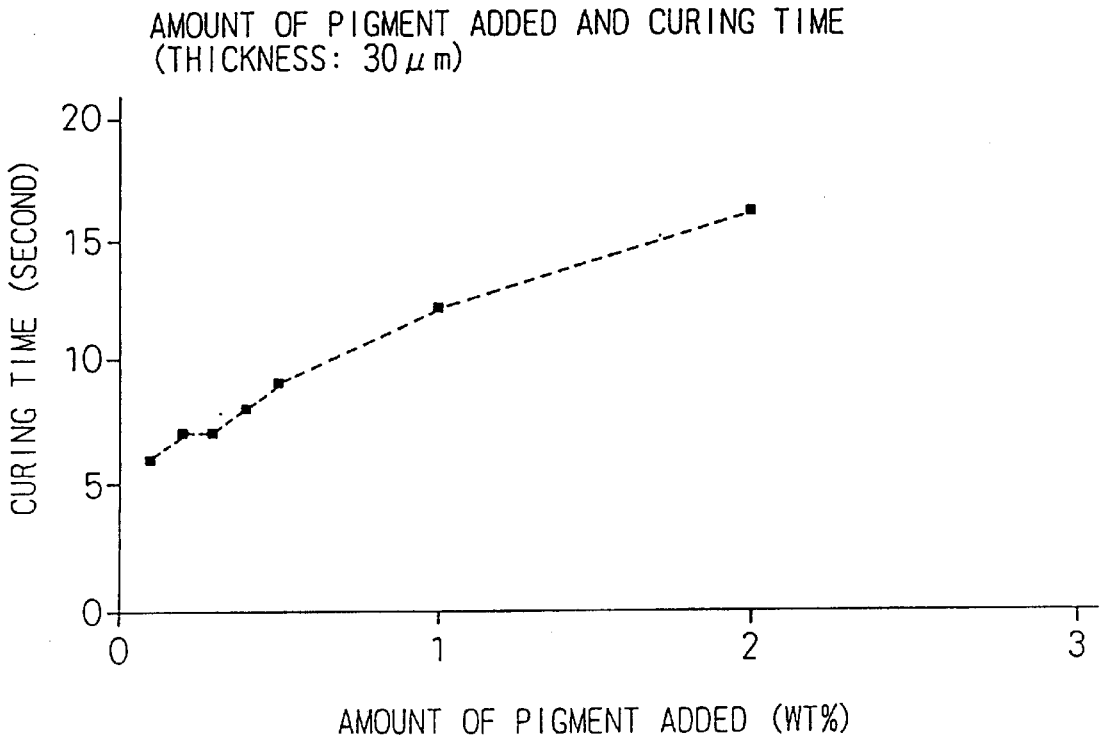
FIG. 30 is a view of an example of the relationship between the amount of the pigment added and the curing time when coloring the paint in the present invention.

Next, UV light is irradiated on the UV curing paint coated on the cut edge to cure the paint. Here, when coloring the UV curing paint, since the transmittance of the UV light falls along with an increase of the amount of the pigment and dye added, it is necessary to decide on the amount of the pigment and dye added considering the balance of the color of the coating after curing and the time for curing the paint in the painting work. FIG. 30 is a graph showing an example of the relationship between the amount of carbon black added as a pigment to the UV curing paint (for example, an acrylate paint) and the curing time one.

The method of irradiation of the UV light may be freely selected from irradiating the entire end edge by a commercially available UV lamp or considering the prevention of ageing of the precoated film by the UV light by using a UV spot irradiation device to irradiate only the cut edge coated with the UV curing paint. The time for irradiation of the UV light is suitably adjusted by the amount of the coloring pigment or dye etc. added to the UV curing paint, but under ordinary conditions an irradiation time of about 20 seconds is sufficient. After the paint cures due to the irradiation of the UV light, when attaching masking tape, the masking tape is peeled off. When not attaching masking tape, the part is completed as an outside part in the cured state.

According to the present invention, there is further provided a method of coating for preventing corrosion of the surface and for concealing the metallic luster since the ferrous metal is exposed at the precoat cut edge. To achieve the above object, in the present invention, the cut edge of the precoated steel sheet is coated with an ordinary temperature drying paint which is then naturally dried to cure the coating at a room temperature or ambient temperature. The ordinary temperature drying paint preferably is made one with a paint viscosity of 500 to 2500 cps to improve the appearance of the cut edge after painting. Further, to conceal the metallic luster of the cut edge, preferably a black pigment is added in an amount of 2% by weight or less and the luster of the painted surface is made 70% or less.

In this embodiment of the present invention, the ordinary temperature drying paint is coated on the cut edge with the ferrous metal exposed by the shearing of the precoated steel sheet etc. The ordinary temperature drying paint cures by natural drying, and therefore, there is no need for facilities for curing the paint such as a heating furnace. As the main resins used as the ordinary temperature curing paint, an epoxy resin, acrylic resin, polyester resin, etc. may be used. If the viscosity of the paint is too high, the paint dries too fast and cures before the coating becomes smooth resulting in a poor appearance. Further, if the viscosity is too low, the paint will drip during the painting, and therefore, the work efficiency will be degraded. Accordingly, to obtain a beautiful paint appearance, a viscosity of 500 to 2500 cps is preferable.

To conceal the metallic luster of the cut edge of the precoated steel sheet, coloring is necessary. Normally the precoated steel sheet is a thin plate of a thickness of 2 mm or less and it is not necessary to match with the color of the paint of the precoated steel sheet when painting the end edge. By adding a black pigment in an amount of 2% by weight or less for coloring and making the luster of the painted surface 35% or less, there is no feeling of metallic luster and it is possible to match with the paint color of the precoated steel sheet. As the black pigment, carbon black, iron oxide, and other coloring pigments used for paints may be used. Further, to lower the luster of the paint, a delustering agent usable as a delustering agent of paints such as colloidal silica may be used. The method for coating the ordinary temperature curing paint is not particularly limited and may be any coating method normally used. It may be selected from methods of coating appropriate for the application of the product and the environment such as spray coating or brush coating.

EXAMPLES

Examples of the present invention will now be explained with reference to the drawings, but the invention is of course not limited to these Examples.

Example 1

Figure 2:
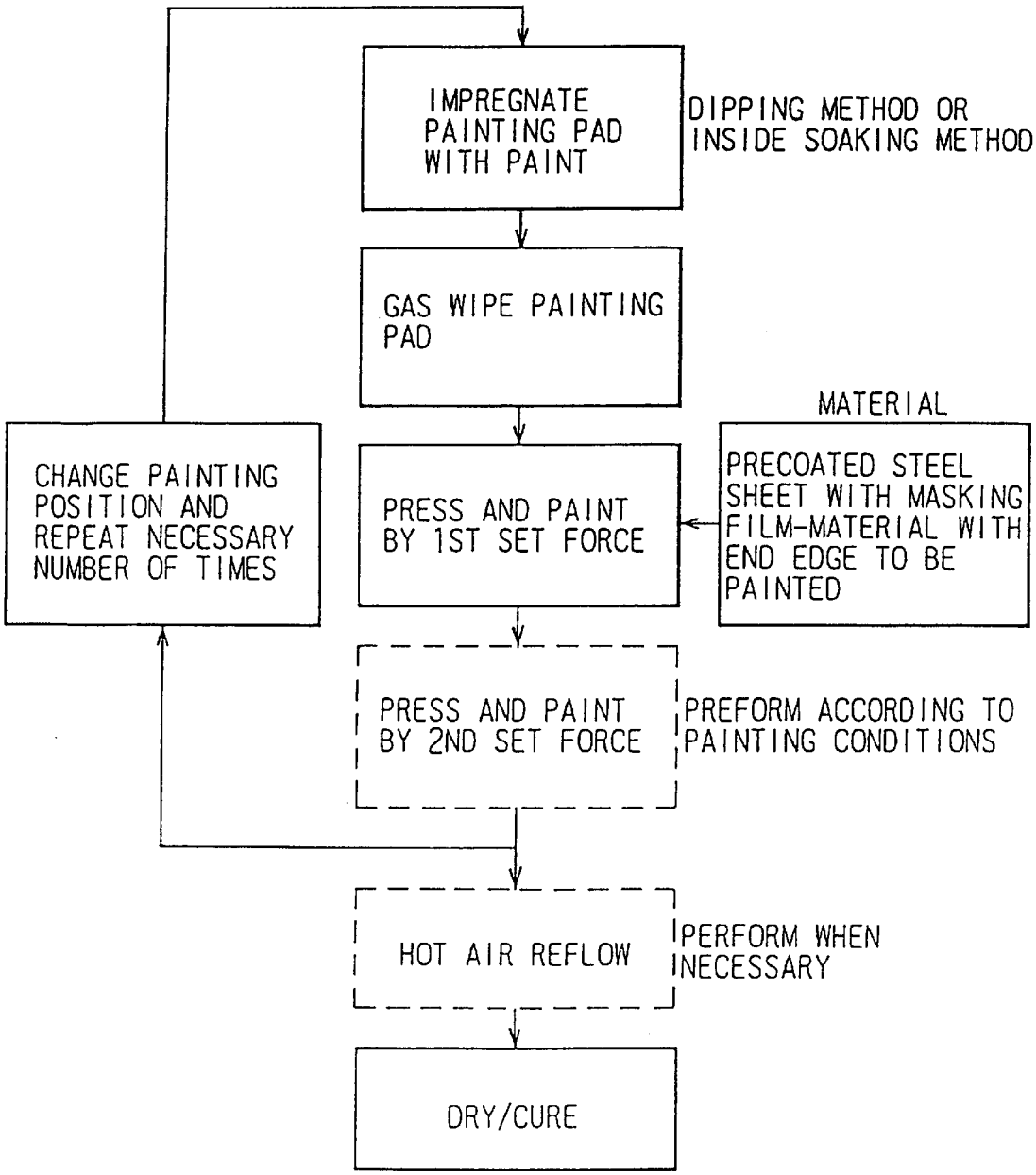
FIG. 2 is a view of the basic process according to an embodiment of the method of the present invention.
Figure 5:
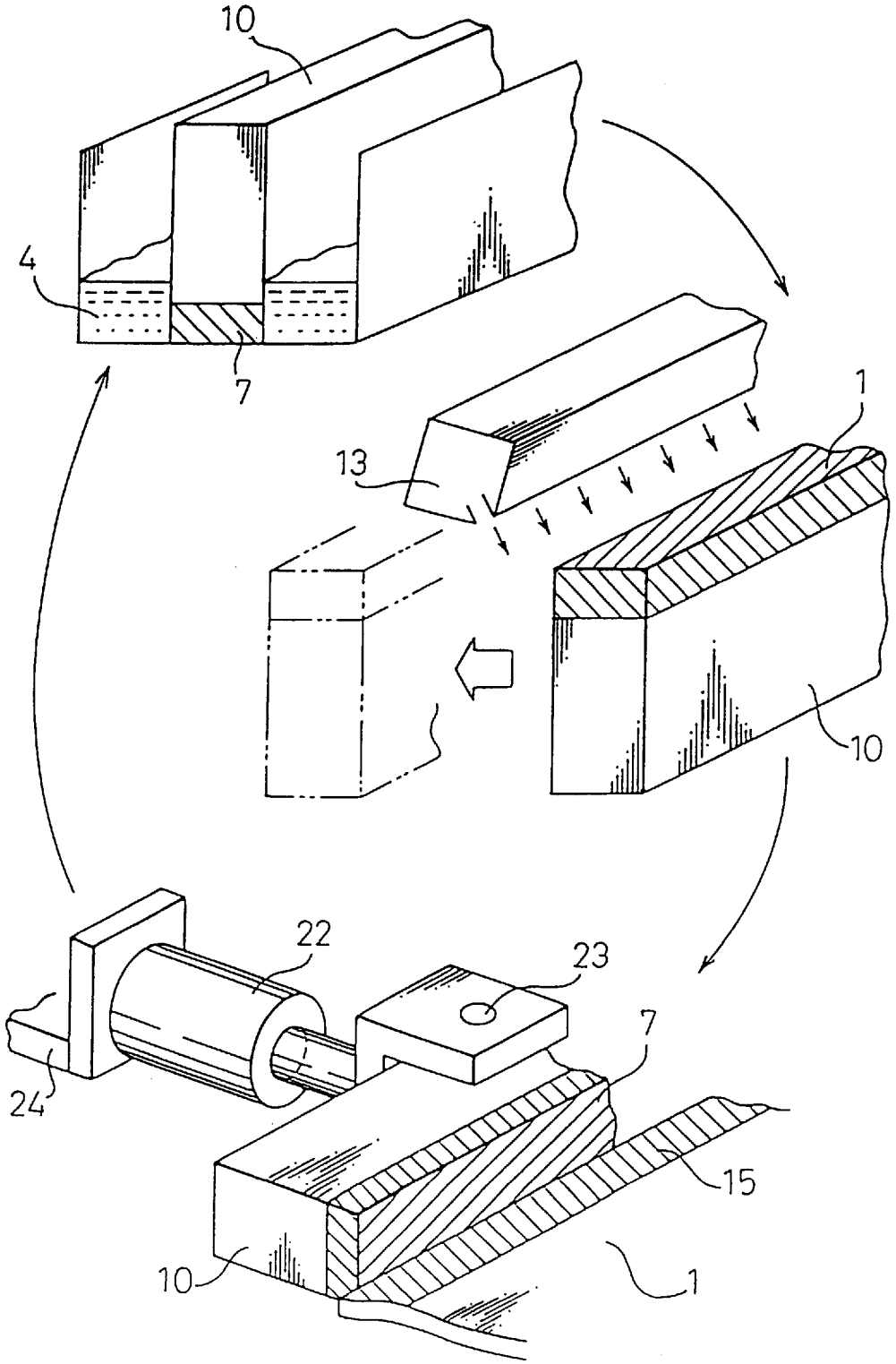
FIG. 5 is a view explaining by a perspective view an example of the basic apparatus for painting a cut edge according to the present invention and an example of its operation.

FIG. 2 is a view of the basic process according to a preferable embodiment of the present invention, while FIG. 5 is a view of an example of the configuration of the apparatus for performing the basic process and its operation.

This example assumes that a masking film is adhered to at least the decorative surface of the precoated steel sheet and the cut edge is then painted. In general, the decorative surface of a product only is present at the one side forming the front surface of the product (the reverse surface is often simply treated to prevent rust), and therefore, the following explanation is made assuming the masking film is adhered to only the decorative surface side, but when necessary it is possible to select and adhere the masking film to one or both sides of the precoated steel sheet. Also, a tape may be used in place of the masking film.

This example is basically composed of a three-stage process. That is, the first stage is the process of impregnating the painting pad 7 with a paint, the second stage is the wiping process for suitably controlling the paint adhered to the surface of the painting pad 7, and the third stage is the process for pressing the painting pad 7 prepared in the above manner against the cut edge of the precoated steel sheet 1 to be painted so as to apply the necessary amount of paint.

First, in the first stage of the process, the painting pad 7 is dipped to a predetermined depth of the paint tank and/or paint is pressure fed from the inside of the painting pad 7 so as to fully impregnate the painting pad with paint the material of the painting pad 7, that is, the sponge or nonwoven fabric and/or woven fabric.

Next, in the second stage of the process, the paint attached on or included in the surface of the painting pad 7 is suitably wiped off by a treatment gas passed through the gas knife portion of the gas knifer header 13. This process is essential because, when just controlling the amount of the paint supplied in the first stage of the process, it is difficult to achieve uniformity and to eliminate the excess paint on the surface and if there is too much paint on the surface of the painting pad 7 at the pressing state of the next stage of the process, too much paint would adhere to the precoated steel sheet 1 and a painted surface with a large number of raindrop like bumps would be formed which is not desirable in terms of the beauty of the appearance.

Gas wiping is employed as the means for wiping the painting pad 7 after too much paint has been applied since if wiping by bringing the painting pad 7 into contact with a solid object such as with wiping by a roller or wiping by a plate shaped blade is used, the uniformity of wiping of the surface could not be easily attained and a large amount of the excess paint removed would remain on the sides other than the surface where the wiping tool came into contact.

That is, it is important that the painting pad 7 be impregnated and held in a state where a suitable amount of paint is uniformly present over the entire surface, that is, without any buildup of paint on the surface. Note that the extent of the wiping is controlled by the strength of the ejected flow (feed pressure) and elapsed time. Of course, the longer the time taken for the wiping, the less the amount of the paint held in the painting pad 7 and the thinner the painting.

Next, at the third stage of the process, the painting pad 7 impregnated with the suitable amount of paint in the above process is pressed by a predetermined pressing pressure against the cut edge (i.e., surface to be painted) of the precoated steel sheet 1, on the precoated decorative surface on which a masking film 15 had been adhered in advance, so as to coat the impregnated paint.

In this way, by impregnating a paint in a painting pad comprised of a sponge or nonwoven fabric and/or woven fabric as a base material and pressing this against the cut edge of the precoated steel sheet concerned, the paint impregnated in the painting pad is squeezed out and made to deposit on the surface. Since the amount of the paint, which is squeezed out, is varied depending upon the pressing force of the painting pad and the maximum pressing force is controlled, it becomes possible to control the amount coated.

In a preferable embodiment of the present invention, when pressing the painting pad 7 against the cut edge of the precoated steel sheet 1 under force control, at least two settings of the pressing force are established. This is because, depending on the viscosity and properties of the paint, a large amount of paint may deposit on a part of the surface and noticeable raindrop like bumps of paint may occur on the painted surface, and therefore, it is preferable to be able to hold the contact by a small pressing pressure for a certain time to reabsorb into the painting pad 7 the raindrop like excess paint squeezed out at the time of the maximum pressing force before pulling back the painting pad 1 from the cut edge of the precoated steel sheet so as thereby to ensure uniformity of the paint adhesion and to reduce the unevenness of the painted surface.

Figure 6:
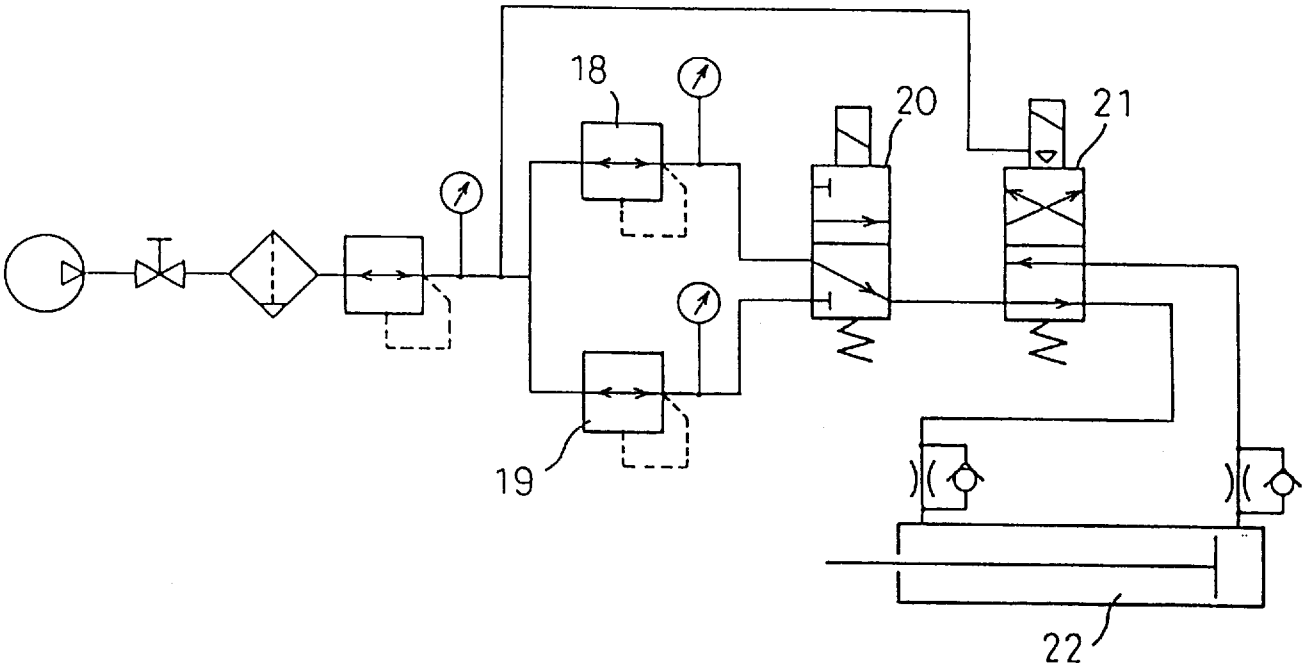
FIG. 6 is a view of an example of an air pressure circuit in the second pressing step of the present invention.
Figure 7:
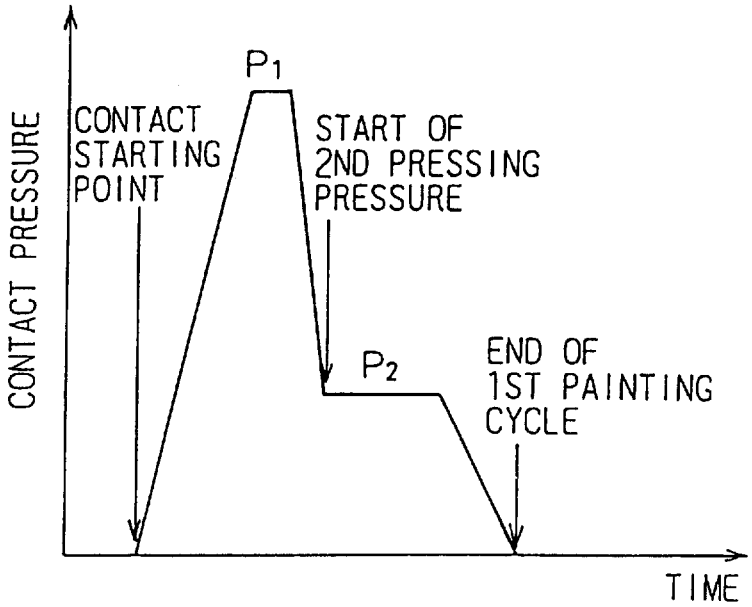
FIG. 7 is a view of an example of the pressure/time chart in the second pressing step of the present invention.

An example of the air pressure circuit for performing this multistage pressing operation is shown in FIG. 6. In this Example, a first pressure regulator and a second pressure regulator are provided. These are switched between so as to perform the operation for pressing the painting pad 7 by a cylinder 22 actuated by an air pressure. A typical example of the pattern of the pressing force generated as a result is shown in FIG. 7. After pressing the painting pad 7 by the pressing force $P_1$ generated by the first pressure regulator 18, the second pressure regulator 19 is turned on and the painting pad 7 is held pressed by the pressing force $P_2$ for a certain time (about one second when ordinary paints are used) so as to absorb in the painting pad 7 the excess paint on or in the cut edge of the precoated steel sheet 1 before the painting pad 7 pulls back from the cut edge of the precoated steel sheet 1. Note that, as the fluid pressure, use of air pressure is most desirable from the viewpoints of ease of handling and cost, but the effect of the painting is unchanged even if oil pressure or other liquid pressure is used.

Figure 8:
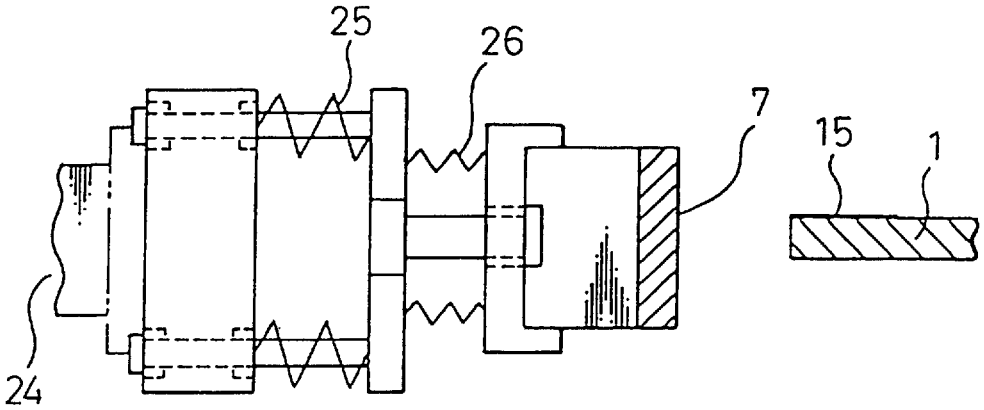
FIG. 8 is a view of an example of a second pressing mechanism using a spring in the present invention.

FIG. 8 is a view explaining a mechanical spring mechanism as another means for performing the multistage pressing operation. According to this mechanism the press in two stages by a combination of two different springs can be effected. A first spring 25 and a second spring 26 are arranged in series. The two springs are made active/inactive at relative positions,of the painting pad 7 and robot hand 24 so as to generate two stages of changes of pressing force.

That is, when the painting pad 7 contacts the precoated steel sheet 1 and the pressing operation of the robot hand 24 then begins, the distance between the painting pad 7 and the robot hand 24 shrinks. At this time, the weaker spring, that is, the second spring 26, is first compressed.

When this proceeds and the second spring 26 is fully compressed (or hits the setting stopper), the stronger spring, that is, the first spring 25, starts to act. The maximum pressing force is generated in accordance with the amount of compression.

When the predetermined maximum pressing force is reached and then the retracting operation is started (namely, when the robot hand 24 begins to be pulled back), the pressing force gradually weakens. The expansion of the first spring 25 is constrained by a guide set to a predetermined length (initial state of first spring 25). Further, when the retracting operation proceeds further, the second spring 26 starts to act and the painting pad 7 is pressed by its elasticity. In the set time until the expansion of the second spring 26 is constrained by a guide set to a predetermined length (initial state of second spring 26), the painting pad 7 is pressed by a weak force against the precoated steel sheet 1, is then pulled back from the painted surface.

In this way, it becomes possible to use a fluid pressure mechanism or a mechanical spring mechanism or a combination of the two as the multistage pressing mechanism.

Figure 3:
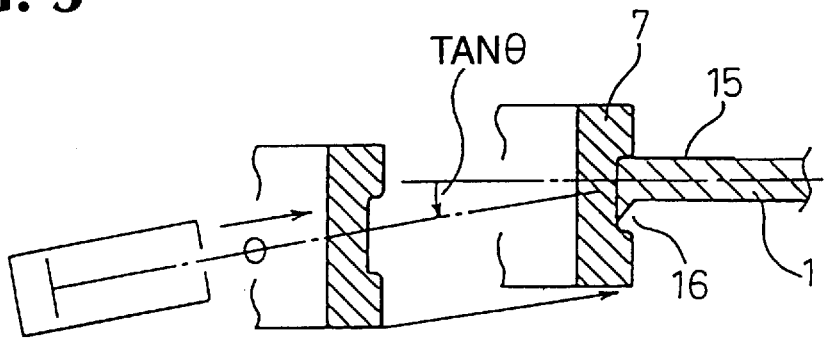
FIG. 3 is a view of pressing the pad from the burr side in the method of the present invention.

In another embodiment, by pressing the painting pad 7 from a direction inclined by an inclination tan $\theta = 1/100$ to $1/3$ from the direction perpendicular to the cut edge of the precoated steel sheet (for example, a direction where the burrs 16 project as shown in FIG. 3) and giving a load of the painting pad 7 at the burr side so as to deliberately coat a larger amount of paint (thick coating) on the burr side, it is possible to make an efficient method of painting capable of covering and concealing the burrs 16 by the paint.

However, when the cut edge of the precoated steel sheet 1 concerned is not straight, as shown in FIG. 3, it is important that the cut edge of the precoated steel sheet 1 and the painting surface of the painting pad 7 be set to become parallel. Here, the lower limit of the inclination tan θof $1/100$ is set since an inclination of at least $1/100$ is required to given a load of an amount corresponding to the minimum height of the burrs (about 10 $\mu$m) since the amount of absorption of the painting pad 7 is about 1 mm. Further, the upper limit of the inclination tan θ of $1/3$ is set, since it is sufficient to project 300 $\mu$m as the maximum height of burrs and since the precoated steel sheet 1 to be painted receives a force turning it up in the direction out of the plane due to the component pressing force of the painting pad 7.

By pressing at an inclination in this way, thick coating at the corners of the surface of the precoated steel sheet at the side of the start of the inclination and thin coating at the corners of the surface of the steel sheet at the opposite side become possible. It is possible to make use of the thin coating opposite to the use of the effect of the thick coating in this way (covering of burrs by paint). For example, it is effective to use thin coating for coating a highly viscous (several hundred poise or more at room temperature) paint evenly by the present invention. That is, this can be achieved by pressing and painting the side of the surface of the precoated steel sheet where it is desired to leave the paint (side opposite to masked surface) as the surface of the end of the inclined pressing.

Figure 4:
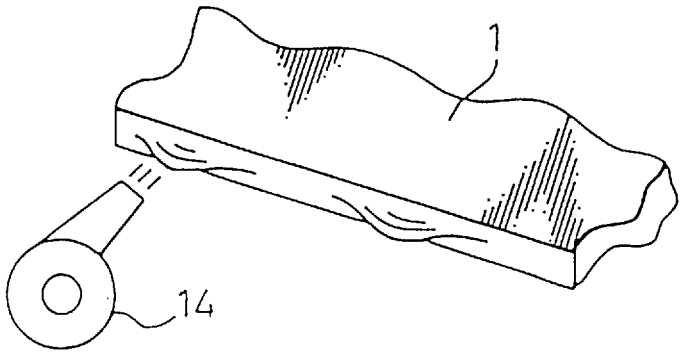
FIG. 4 is a perspective view of the reflow caused by hot air before drying and curing after the painting according to the method of the present invention.

In another embodiment, when, after the above three steps of the basic process, there still remain the raindrop like bumps caused by the paint on the painting surface having a high viscosity, it is preferable as shown in FIG. 4 to blow hot air etc. before the drying and curing so as to raise the temperature of the portion where the paint is deposited and temporarily lower the viscosity and thereby cause the paint at the bump portions to flow by the surface tension and gravity so as to smooth the painting surface. In particular, when using a UV curing paint, the paint will not solidify due to the hot air, and therefore, the effect of smoothing the painting surface is large. Further, if possible, when the paint bumps on the painting surface are made to reflow by hot air in a perpendicular state where they are positioned at the top, the effect of gravity is added and a higher effect is obtained so this is even more preferred.

For the performance of the actual steps of the three-stage basic process of the present invention, a minimum of three stations are provided, that is, a station for impregnating the paint in the painting pad 7, a station for wiping the paint off the surface of the painting pad 7 by a gas knife, and a station for pressing the painting pad 7 to the cut edge of the precoated steel sheet. A robot is made to hold the painting pad 7 and to move it between these stations, while performing the predetermined treatment. By this, the simplest practical process can be realized. Of course, depending on the amount of production, it is also possible to make a special processing machine and perform these processes by an assembly line type of operation. Since the outer plate part is completed by drying and curing the finally coated paint, the product is completed by assembling it with other component parts of the product.

The painting pad 7 may be configured as a sponge or a nonwoven and/or woven fabric attached to a rigid base to be impregnated with paint and hold the same. However, when thick painting is required, to impregnate and coat a large amount of paint, an inside base material of a sponge or soft nonwoven fabric may be used. Further, to make the space between the thin and the dense portions of the paint on the surface of the painting pad 7 on the micrometer order, it is preferable to configure the painting pad 7 to cover the sponge or nonwoven fabric with a woven fabric.

Figure 9:
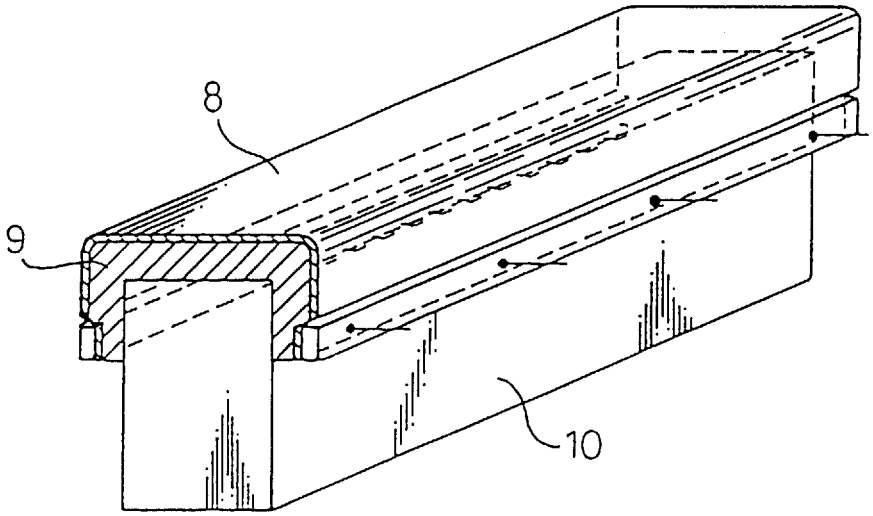
FIG. 9 is a view of an example of a painting pad comprised of a nonwoven fabric around the outside of which is wound a woven fabric in the present invention.

FIG. 9 shows an Example of the construction of a painting pad composed of an inner base material of a nonwoven fabric 9 covered on its surface with a woven fabric 8.

If a painting pad 7 without an outside woven fabric is brought into contact with the surface to be painted, in the case of a nonwoven fabric, fluffing occurs at the contact surface and when the painting pad 7 is pressed and then separated, small bump-like depositions of paint may occur or bubbles may be present at the painted surface, which are not desirable. Even in the case of a sponge painting pad without an outer woven fabric, while there is no fluffing at the contact surface, there are large differences in the density (or space between the thin and the dense portions) of the paint at the surface and a similar problem is feared.

The sponge or nonwoven fabric and/or woven fabric forming the base material of the painting pad 7 is mainly composed of an organic compound, chemical fiber, etc., but is not limited to the same. Any suitable material may be selected depending upon the paint used. The thickness of the painting pad 7 also may be suitably selected depending upon the properties of the paint (viscosity etc.) and the aimed at paint thickness, but in view of the hardness of the painting pad and the suitability of the compression, generally is 0.5 to 10 mm.

Further, the material of the rigid base 10 is not particularly limited and may be suitably selected from wood, plastic, metal, etc.

Further, the paint may be freely selected from paints suitable for the application of the product and the environment, but by using a UV curing type (generally called a UV curing paint), since no organic solvent is needed, it is possible to set up a painting system most preferable in terms of the working environment.

The preferred embodiment of the present invention will be explained in further detail by the Example shown in FIG. 5.

In this Example, the impregnation of paint into the painting pad 7 is performed by the method of dipping. The object is achieved by inserting the painting pad 7 to the bottom of a container having a level of paint of a suitable depth (i.e., depth whereby entire painting pad is substantially dipped).

Figure 10:
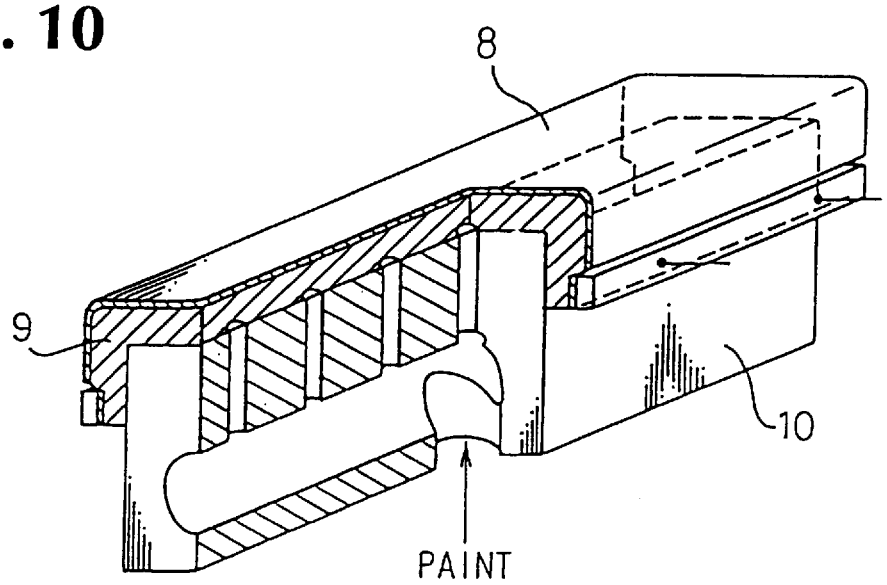
FIG. 10 is a view of an example of a painting pad for soaking which supplies paint from the inside in the present invention.

Note that this impregnation of the painting pad 7 with paint can also be performed by pressure feeding the paint to the inside of the painting pad base 10 to impregnate it from the inside as shown in the Example of FIG. 10.

Next, the painting pad 7 is passed across the curtain like flow of gas of the gas knife header 13 having the slit nozzle so as to wipe the surface of the painting pad 7 and to remove the excess paint from the surface. At this time, it is sufficient to give a forward ejection angle so as to raise the wiping efficiency. Note that the direction of wiping the painting pad 7 is not particularly limited, but if the direction of thickness of the painting pad 7 shown in FIG. 5 is used, the length passed across is short, and therefore, the treatment time is short and productivity is high. However, in this case, a gas knife header 13 having a long slit is necessary.

Next, the painting pad 7 is pressed against the cut edge of the precoated steel sheet 1 having the masking film 15 on a decorative surface. At this time, the pressing operation is performed by the cylinder 22. An example of the air pressure circuit at this time is shown in FIG. 6. According to this circuit, the pressure selector 20 is demagnetized to operate the cylinder at a pressure set by the first pressure regulator 18 (e.g., a maximum pressing force (i.e., linear pressure) of 5N/cm) in the pressing direction by the direction control valve 21, then, when the contact of the painting pad 7 with the precoated steel sheet 1 reaches the maximum pressing force, the pressure selector 13 is magnetized to hold this at a pressure set by the second pressure regulator 19 (e.g., a minimum pressing force (linear pressure) of 0.5N/cm) for a predetermined time (about 1 second), then the direction control valve 21 is switched to pull in the cylinder 22 and separate the painting pad 7 from the precoated steel sheet 1, whereby the series of pressing and painting operations is ended.

To perform this movement between stations for the series of processing, the movement for the gas wiping by the gas knife header 13, and the posturing and position operation of the pressing operation of the painting pad 7, it is possible to attach the painting pad 7 to the painting pad base 10 and attach this to a robot hand 24 to realize all of the operations (including the inclined pressing at an inclination tan θ) by the simplest hardware configuration.

Note that to absorb deviations in the operating precision of the robot and positioning precision of the precoated steel sheet to be painted, as shown in FIG. 5, it is preferable if the painting pad base 10 and the cylinder 22 are connected by a rotational pin 23 and the painting pad 7 is made rotatable along with the contact in the longitudinal direction of the cut edge.

Figure 11:
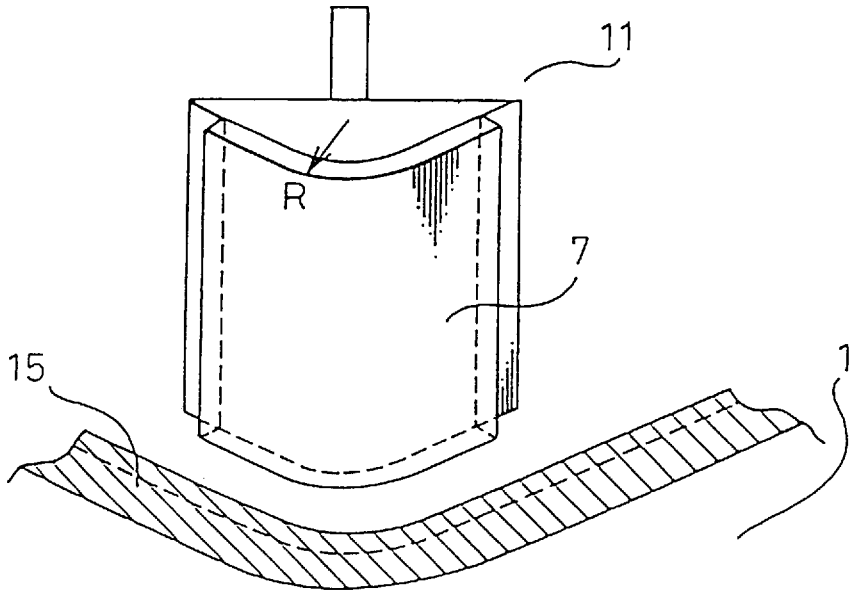
FIG. 11 is a view of an example of the configuration of a painting pad for corner portions in the present invention.

Further, when the length of the painting pad 7 is shorter than the length of the painted cut edge of the precoated steel sheet concerned, it is sufficient to repeat the pressing and painting operation giving some overlap so as to paint the overall required length. Further, when the cut edge to be painted is curved, the painting pad is made a painting pad with a similar curve. For example, with a cut edge having curvature at the open corner portion, a corner painting pad 11 having a similar curvature as shown in FIG. 11 may be used to perform a similar series of pressing and painting operations as above. Of course, it is also possible to have a single robot hold a plurality of different types of painting pads and switch them in use or to operate a plurality of painting pads by fluid pressure at the same time (by simultaneously operating pads facing each other in opposite directions, the backlash can be canceled out) or have a plurality of robots operate in concert.

In this Example, the pressing force of the painting pad 7 was changed by air pressure, but it is also possible to have the same operation performed by the mechanical spring mechanism shown in FIG. 8 or to use a composite mechanism of the same. Further, the above controlled force pressing mechanism may be used not to move the painting pad 7 but to move the precoated steel sheet 1 as well, so the same effect is given as if providing the support mechanism of the precoated steel sheet 1 with a multistage pressing force setting mechanism and moving mechanism.

Example 2

Figure 12:
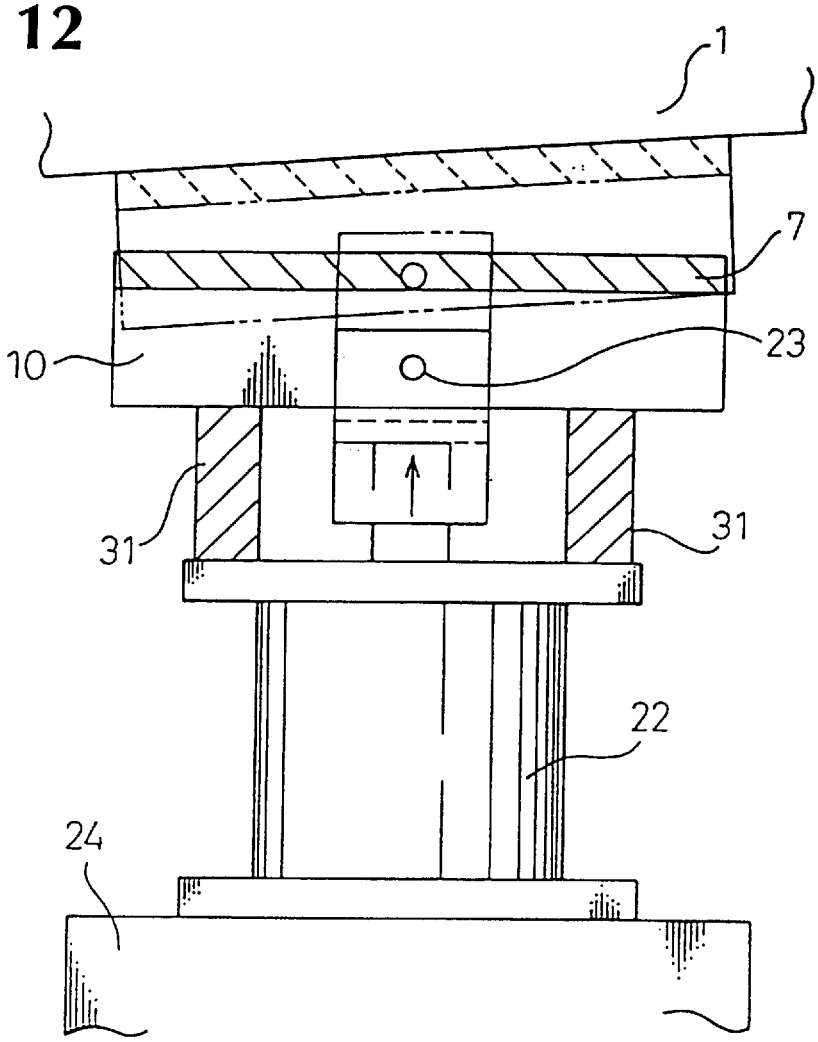
FIG. 12 is a view of an example of the configuration of the painting pad of a rotating construction in the present invention.
Figure 13:
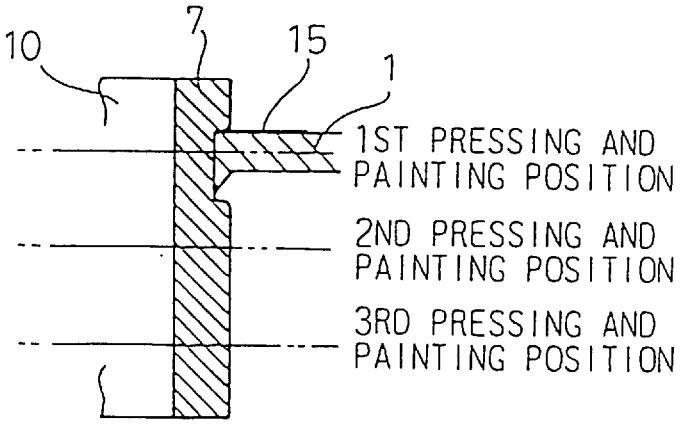
FIG. 13 is a view of the painting position of a painting pad having a width for pressing and painting several times in the present invention.
Figure 14:
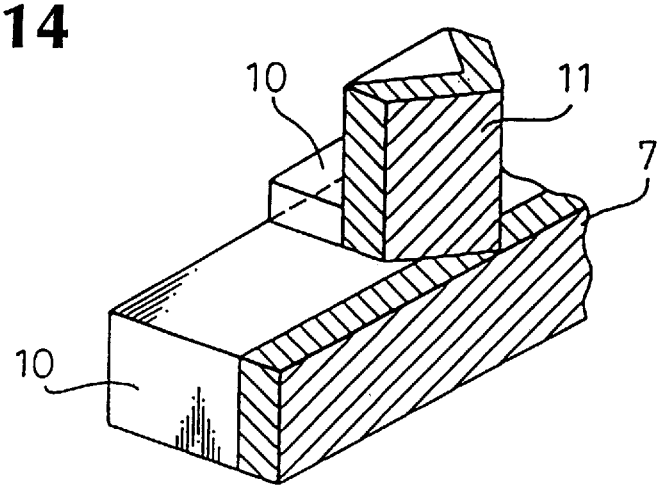
FIG. 14 is a view of the construction of a painting pad composed of an assembly of a straight portion painting pad and a corner portion painting pad of the present invention.

As shown in FIG. 12, in the present embodiment, the painting pad 7 is made rotatable in construction. When retracting the pressing mechanism (e.g., the air cylinder) 22, the rotation of the painting pad 7 is constrained by the mechanical stopper 31. When controlling the amount of the paint deposited on the surface of the painting pad 7 by a gas knife header 13, by constraining the rotation of the painting pad 7, the painting pad 7 is rocked by the pressure of the gas flow and the distance between the gas knife header and the painting pad 7, that is, the effect of the gas knife, becomes nonuniform and, as a result, differences occur in the amount of deposition of paint on the surface of the painting pad depending on the location In FIG. 13, the width of the painting pad 7 is made greater than the width necessary for pressing and painting a single time, the amount of the paint attached to the surface of the painting pad 7 is controlled by a single pass of the painting pad 7 by the gas knife header, and then, during the pressing and painting, the position of the painting pad 7 in the width direction is successively changed to perform several pressing and painting operations. When controlling the wiping by the amount of the paint deposited on the surface of the painting pad 7 by the gas knife header, there is a limit to the speed of the wiping by the gas knife. This takes the most time in the painting process. Therefore, by performing several pressing operations with a single wiping, the overall painting time can be reduced compared with performing wiping each time. Note that, if high speed wiping is made possible by wiping at a high pressure (0.1 Pa or more), the jet noise becomes extremely great, use is not possible in normal factory environments, and the energy efficiency is poor. Further, with pressing and painting several times using the same location, a reduction of the impregnated paint has a direct effect and the later pressed and painted amount gradually falls which creates a problem in the stable deposition of the paint. In practice, by moving the contact position of the painting pad by a distance about three times the thickness of the paint, there is almost no effect of the reduction of the amount of paint in the previous painting, and therefore, the contact position of the pressing pad and the painted material is moved several mm each time for the painting, whereby new portions can be painted several times, while maintaining the same paint quality. Further, it is possible to make the corner portion painting pad 11 as shown in FIG. 14 and the straight portion painting pad 7 superposed in structure and perform the gas wiping of the two pads by a single pass of the gas knife header portion, and therefore, continue the pressing and painting several times for the corner portion as well.

Figure 15:
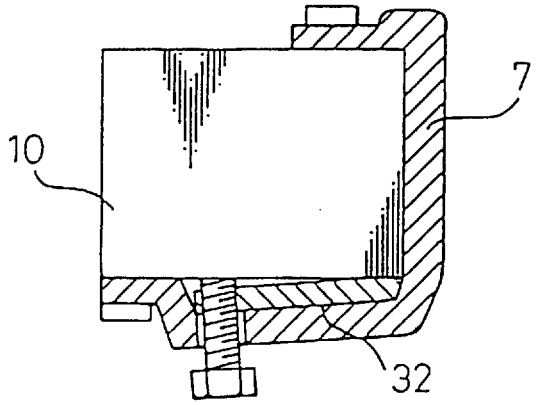
FIG. 15 is a view of a painting pad using a jack plate of the present invention.

FIG. 15 shows a painting pad 7 provided with a mechanism for tensing the woven fabric of the surface of the pressing painting pad for making the tension of the woven fabric of the surface adjustable by a screw. When pressing and painting the pad, the stability of the elasticity (or amount of depression by set pressing force) of the surface woven fabric and/or surface nonwoven fabric is important to the quality of the painting. As the easiest method for this, the force attaching the woven fabric and/or the nonwoven fabric to the base material is controlled and set. As a specific example of the mechanism FIG. 15 shows the method using a jack plate 32. By this, it is possible to readjust the change in elasticity over time of the woven fabric and/or the nonwoven fabric of the painting pad, and therefore, long term stable use becomes possible.

Example 3

Figure 16:
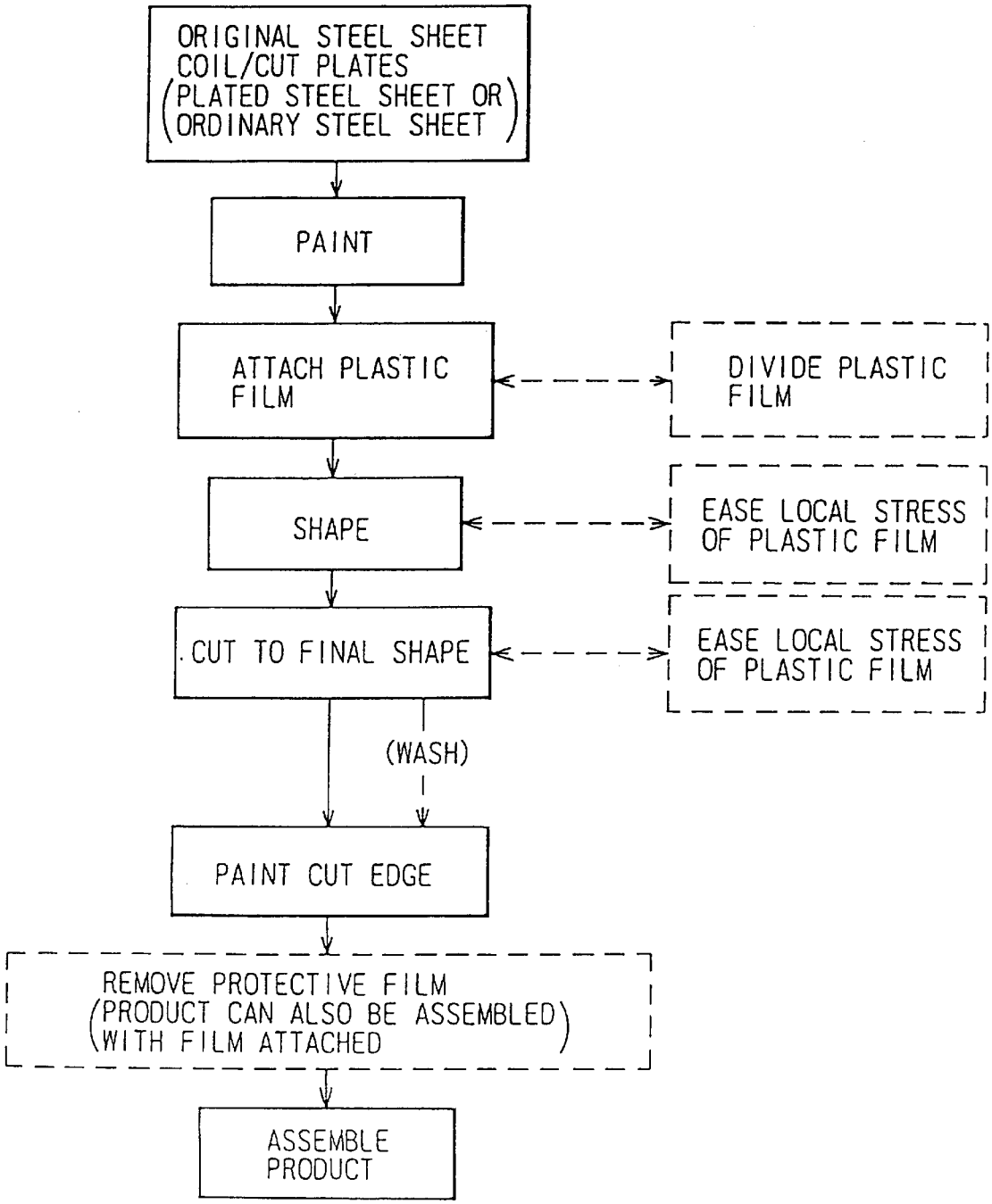
FIG. 16 is a view of the basic process of another embodiment of the method of the present invention.

FIG. 16 is a flow chart of the basic routine from the painting of the material to the post-painting according to an embodiment of the present invention. A suitable plastic film appropriate to the elongation rate and other conditions of the product to be processed is selected and adhered to a steel sheet painted in the state of a coil or cut plates (sometimes steel sheet plated to enhance its rust-proofing effect).

Note that, when there is a large amount of strain in the shaping, the shaping is performed divided into several steps. Some products, however, are of shapes where part of the plastic film will unavoidably wrinkle or peel off due to the first steps of the processing. Details of this are explained using the example of a product of a container shape having a rectangular cylindrical shape and provided with an opening 4 at part of the rectangular cylinder (bottom) shown in FIG. 17.

Figure 18:
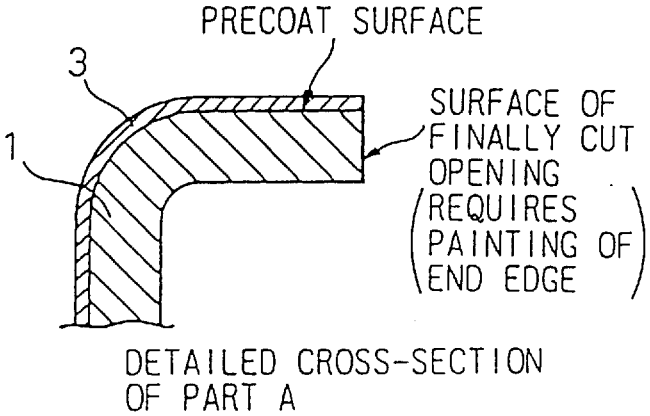
FIG. 18 is a view of details of the cross-section of the portion A of FIG. 17.
Figure 19:
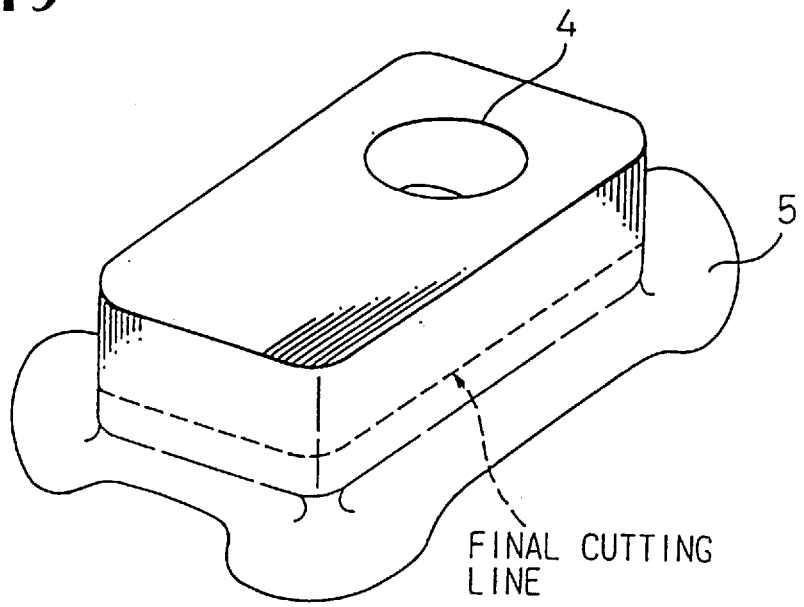
FIG. 19 is a perspective view of a shaped article for explaining the pressing in the shaping and the wrinkling of the plastic film.
Figure 20:
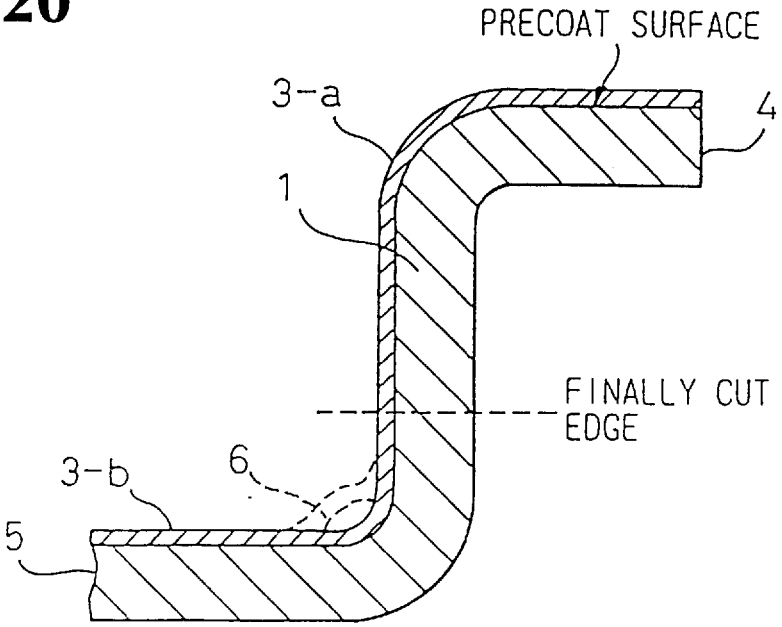
FIG. 20 is a cross-sectional view including the opening 4 of FIG. 19.

The products of FIG. 17 and FIG. 18 are fabricated by shaping into a rectangular cylinder by drawing by a press and then cutting off the flange portion 5 and the opening 4 as shown in FIG. 19. At this time (when shaping), the precoated steel sheet 1 including the plastic film receives a complicated processing strain at the die shoulder R portion, and therefore, at the corner portion 6 of the shaped article corresponding to this portion, the plastic film easily rises up or flows up on its own as shown by the dotted line in FIG. 20. Accordingly, when the draw ratio is large and two steps of shaping are required, the rise of the plastic film at the first step of drawing becomes wrinkles which are printed on the surface of the product at the second step of drawing in some cases. It is desirable to start the second step of processing after removing the plastic film at the wrinkled corner portion 6. The opening 4 made by cutting and removal after the end of the drawing has to be post-painted at the cut edge, and therefore, it is necessary to leave the plastic film at that portion.

Accordingly, before attaching the plastic film 3 to the precoated steel sheet 1 in the state of the original flat plate, the portion of the plastic film 3 corresponding to the corner portion 6 is given perforations in a rectangular shape corresponding to the final shaped article, The first drawing is performed in the state with the perforations. Due to this, it is possible to separate the plastic film 3-*b* attached to the flange portion 5 and the plastic film 3-*a* at the final product side, and therefore, separate and remove only the plastic film 3-*b* with the wrinkles. Next, the second step of drawing is performed to make the product the finished shape, then the plate is finally cut along the final cut edge of FIG. 17 and the opening 4 is cut open.

In the above way, it is possible to process the plate without causing flaws by the plastic film 3 at the time of the second step of the process. Also, since the plastic film 3-*a* matching the shape of the opening 4 remains attached, it is possible to mask the plate against spreading of the paint by the plastic film 3-*a* at the time of the post-painting of the cut edge of the opening 4. Of course, in a product of an amount of shaping where the finished shape can be given in a single draw, there is no need for perforation or other advance processing of the plastic film 3.

The precoated steel sheet produced in the above manner is shaped in the state with the plastic film attached by the product manufacturer to become the shape of the final shaped article. Further, the flange portion, which becomes a surplus portion in the final product, the opening, which is cut in the final process to accurately give the final shape, etc. are finally cut and removed to give the finished shape of the product. At the same time, the plastic film also is given the same profile as the finally shaped article since it is attached to the surface of the precoated steel sheet.

Note that, during the above process, deformation occurs to the plastic film by the processing and cutting. When, due to the residual stress and residual strain, there is a danger of peeling of the plastic film at the portion requiring masking at the time of the final process, that is, the post-painting, the local stress of the plastic film is suitably relaxed by softening and elongation by heating or release of the residual stress by partial cutting etc.

Next, in the post-painting process, the ferrous metal of the cut edge exposed by the final cutting is painted. As shown in FIG. 17, the plastic film performs the role of a masking tape, and therefore, the painting can be performed by ordinary painting, without worrying about spreading. Note that, when the press oil or other residual oil obstructs the deposition of the paint, it is preferable to remove the oil by washing the cut edge with alkali before the post-painting.

When the painting of the cut edge (including drying) is finished, the outer plate part is completed. Thus, the other component parts of the product are assembled to complete the product. Note that the plastic film may be peeled off from the outer surface of the precoated steel sheet at the point of time, when the painting is finished or may be peeled off after the product is assembled so as to prevent flaws at the time of assembly.

Example 4

In this example of the present invention, first, a precoated steel sheet composed of a steel sheet successively given a chromate treatment, primer coat, and top coat was sheared into 100 mm×50 mm sizes to prepare test samples. Next, the UV curing paints composed of the compositions shown in Table 1 were formulated and brush coated to a thickness of 30 $\mu$m on to the sheared end edges of the pieces of the precoated steel sheet. As the UV curing paint, a urethane acrylate resin type was used. Note that in some cases an organic resin type masking tape was attached to the sheared portions. Next, a UV apparatus was used to irradiate the coated surfaces with UV light for 20 seconds.

The test samples were examined for the presence of a feeling of metallic luster at the end edges and were evaluated for corrosion resistance by a method according to JIS (i.e., Japanese Industrial Standard)-Z0228. The evaluations of the corrosion resistance were based on the following criteria:

Good: No rusting observed.

Fair: Some rusting observed.

Poor: Large amount of rusting.

The results of the evaluation are shown in Table 1. As is clear from the Table, the test samples covered at the sheared end edges by the method of the present invention were superior in corrosion resistance. Further, by just adding 2% by weight or less of a pigment to the paint, the feeling of metallic luster of the end edges disappeared. However, the amount of the pigment formulated is preferably 2% by weight is view of the curing of the paint. Further, it was possible to use an organic resin type of masking tape which was not able to be used in the past.

TABLE 1

| | UV curing paint | | | | | |
|---|---|---|---|---|---|---|
| No. | Coloring pigment | Amount of pigment added | Masking tape | Feeling of metallic luster | Evaluation of corrosion resistance | Remarks |
| 1 | Black carbon | 0% | PVC | Yes | Good | Present invention |
| 2 | Black carbon | 0.1% | PVC | Some | Good | |
| 3 | Black carbon | 0.2% | PVC | No | Good | |

TABLE 1-continued

| | UV curing paint | | | | | |
|---|---|---|---|---|---|---|
| No. | Coloring pigment | Amount of pigment added | Masking tape | Feeling of metallic luster | Evaluation of corrosion resistance | Remarks |
| 4 | Black carbon | 0.5% | PVC | No | Good | |
| 5 | Black carbon | 1.0% | PVC | No | Good | |
| 6 | Black carbon | 2.0% | PVC | No | Good | |
| 7 | Black carbon | 0.2% | PP | No | Good | |
| 8* | Black carbon | 4.0% | PVC | No | Good | |
| 9 | | None | None | Yes | Poor | Comp. Ex. |

**There are some problems in the curing time.

(Remarks)

PVC = poly(vinyl chloride)

PP = polypropylene

Example 5

In this Example of the present invention, first, a precoated steel sheet composed of a 0.6 mm thick steel sheet successively given a chromate treatment, primer coat, and top coat was sheared into 100 mm×50 mm sizes to prepare test samples. Next, the ordinary temperature curing paints composed of the compositions shown in Table 2 were formulated and brush coated to a thickness of 50 $\mu$m onto the sheared end edges of the pieces of the precoated steel sheet. When painting, a masking tape was attached to the surface of the precoated steel sheet and just the cut portions of the end edges were painted. As the ordinary temperature curing paint, an acrylic resin type was used. Next, the test samples were allowed to naturally dry for 72 hours to cure the paint.

The test samples were visually examined for the presence of a feeling of metallic luster at the end edges and the harmony with the paint color of the precoated steel sheet. Further, the corrosion resistance was evaluated by a method according to JIS-Z0228. The evaluations of the corrosion resistance were based on the following criteria:

Good: No rusting observed.

Fair: Some rusting observed.

Poor: Large amount of rusting.

The results of the evaluation are shown in Table 2.

TABLE 2

| No. | Ordinary temperature drying paint: Coloring pigment (amount added) | Gloss (%) | Viscosity (cps) | Paint appearance | Feeling of metallic luster | Harmony with precoat color | Evaluation of corrosion resistance |
|---|---|---|---|---|---|---|---|
| 1 | — | 70 | 1000 | Good | Yes | Not | Good |
| 2 | Carbon black (0.1 wt %) | 70 | 1000 | Good | Some | strange | Good |
| 3 | Carbon black (1 wt %) | 70 | 1000 | Good | Some | | Good |
| 4 | Carbon black (2 wt %) | 30 | 1000 | Good | No | | Good |
| 5 | Carbon black (2 wt %) | 70 | 1000 | Good | No | | Good |
| 6 | Carbon black (2 wt %) | 80 | 1000 | Good | No | Strange | Good |
| 7 | Carbon black (3 wt %) | 70 | 1000 | Good | No | | Good |
| 8 | Carbon black (2 wt %) | 70 | 300 | Poor | No | Not strange | Good |
| 9 | Carbon black (2 wt %) | 70 | 500 | Good | No | | Good |
| 10 | Carbon black (2 wt %) | 70 | 2500 | Good | No | | Good |
| 11 | Carbon black (2 wt %) | 70 | 3000 | Poor | No | | Good |
| 12 | Not yet painted (comparative) | | | — | — | — | Poor |

As is clear from the results of Table 2, the test samples covered at their sheared end edges by the method of the present invention were superior in corrosion resistance. Further, by just the addition of 2% by weight or less of a pigment to the paint and reducing the paint gloss to 70% or less, the feeling of metallic luster of the end edge disappeared. Further, a beautiful paint appearance could be obtained in the case of a paint viscosity of 500 to 2500 cps.

Figure 21:
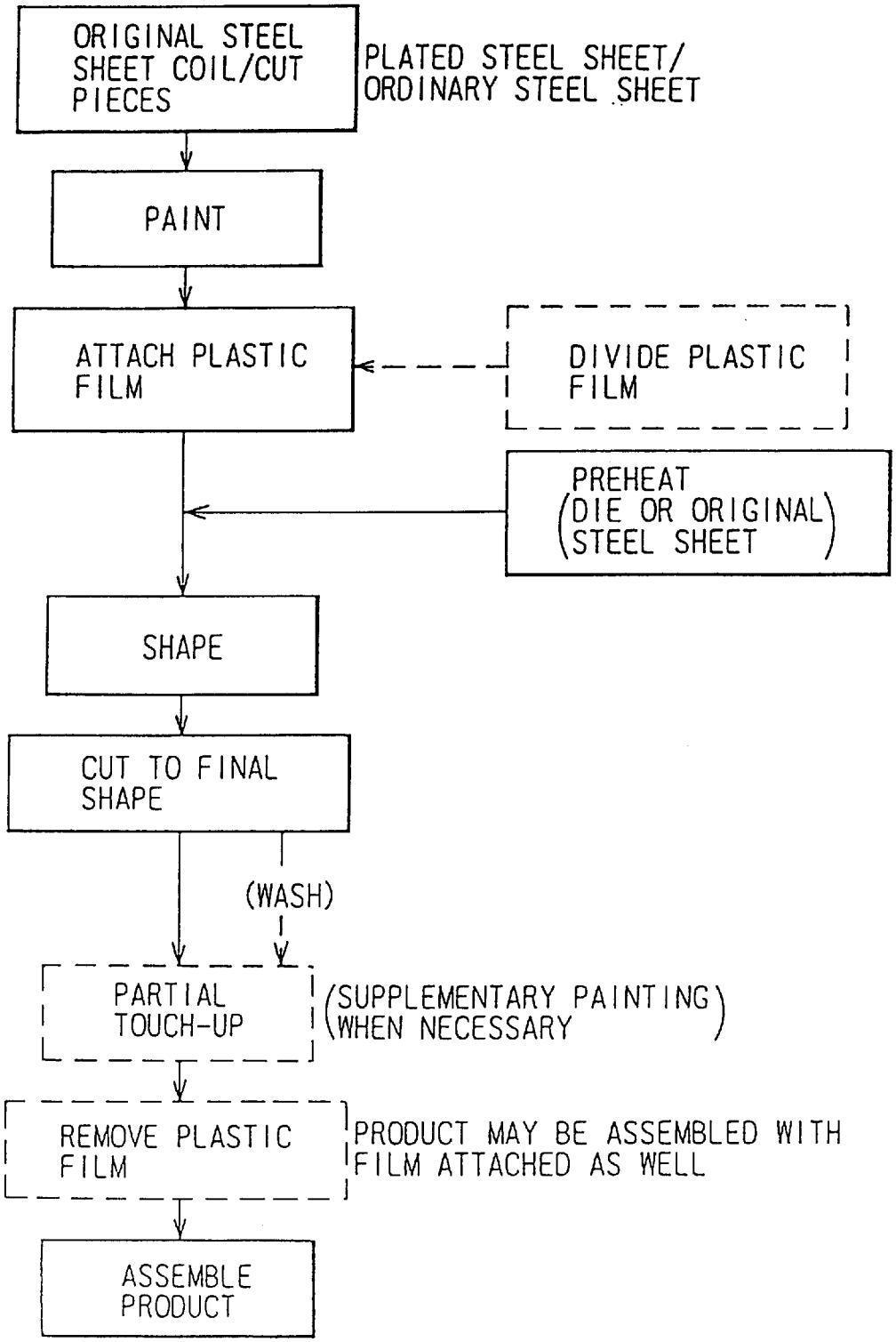
FIG. 21 is a view of the basic process of another embodiment according to the method of the present invention.

In this Example of the present invention, as shown in the flow chart of FIG. 21, the basic routine from the painting of the material to the post-painting of the present invention is shown. A suitable plastic film appropriate to the elongation rate, reactivity with the processing oil to be used, and other conditions of the product to be processed is selected and adhered to a steel sheet painted in the state of a coil or cut plates (sometimes steel sheet plated to enhance its rust-proofing effect).

When there is a large amount of strain in the shaping, the shaping is performed divided into several steps. Some products, however, are of shapes where part of the plastic film will easily wrinkle or peel off due to the first steps of the processing. Details of this are explained using the example of a product of a container shape having the rectangular cylindrical shape shown in FIG. 22.

Figure 22:
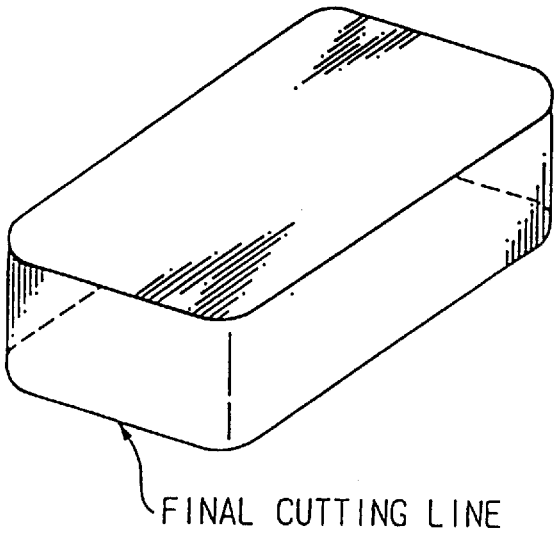
FIG. 22 is a view of an example of a product (part) in the present invention.
Figure 23:
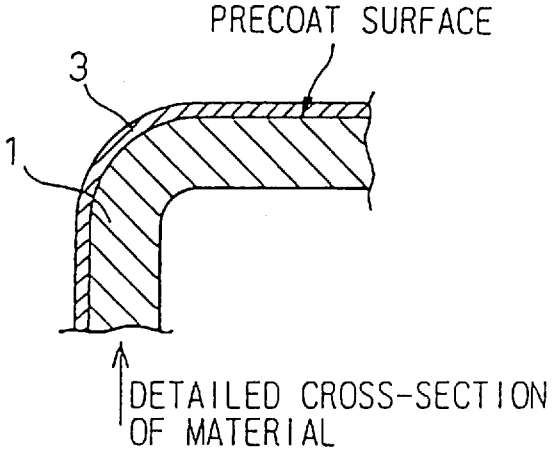
FIG. 23 is a view of details of the cross-section of the material of the product in the present invention.
Figure 24:
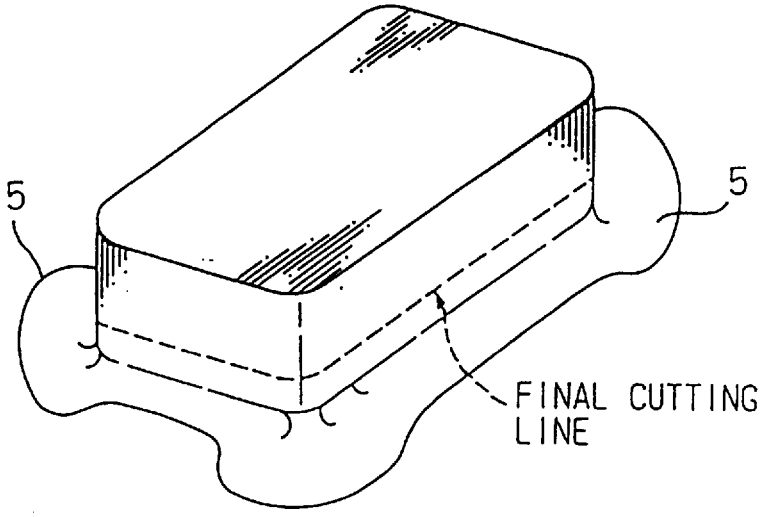
FIG. 24 is a view of the intermediate state for shaping the product of FIG. 22.
Figure 25:
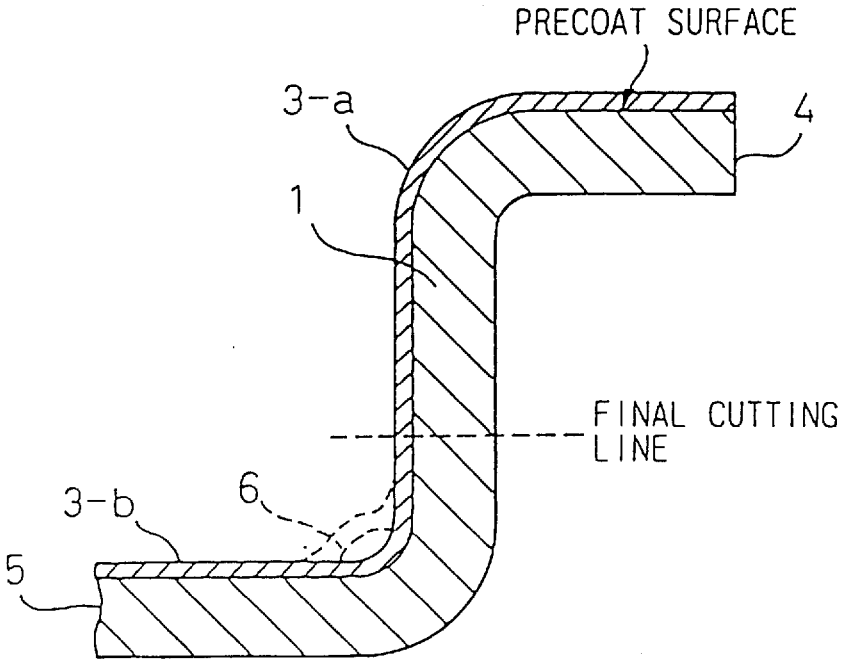
FIG. 25 is a view of explaining the wrinkling of a plastic film in the shaping of the present invention.

The product of FIG. 22 is fabricated by shaping into a rectangular cylinder by drawing by a press and then cutting off the flange portion 5 as shown in FIG. 23. At this time (when shaping), the precoated steel sheet 1 including the plastic film 3 receives a complicated processing strain at the die shoulder R portion, and therefore, at the corner portion 6 of the shaped article corresponding to this portion, the plastic film easily rises up as shown by the dotted line in FIG. 25. Accordingly, when the draw ratio is large and two steps of shaping are required, the rise of the plastic film at the first step of drawing becomes wrinkles which are printed on the product at the second step of drawing in some cases. It is necessary to perform the second step of processing while preventing this rise at this portion.

Polyvinyl chloride was used as the plastic film in the processing of this product. The changes in the tensile elongation characteristic of the material due to temperature are shown in FIG. 26. In this way, when the temperature of the polyvinyl chloride film is at least 55° C., the tensile stress is halved and the elongation becomes a sharp one of 100% or more, and therefore, a characteristic close to superplasticity is exhibited. Accordingly, if the shaping is performed at this temperature or more, even if a large shaping strain is applied to the precoated steel sheet with the polyvinyl chloride plastic film adhered to it, there will no longer be any peeling of the polyvinyl chloride plastic film.

The portions where flaws tend to occur on the painted surface of the precoated steel sheet during process can be predicted in advance from experience or experiments, and therefore, it is also possible with shaping products with large areas to divide it into portions of the painted surface desired to be protected during the shaping and to portions not so desired and adhere the plastic film only to the former portions so as to save of the amount of the plastic film used.

After the shaping, the flange portion is cut off to complete the outer plate part, so the other component parts of the product are assembled to complete the product. Note that the plastic film may be peeled off from the outer surface of the precoated steel sheet at the point of time when the shaping is finished or may be peeled off after the product is assembled so as to prevent flaws at the time of assembly.

As the method for heating for the hot shaping, since a high temperature is not required, it is possible to heat the die by steam or hot water, hot oil, electromagnetic waves, etc. or to heat the precoated steel sheet before placing it in the shaping machine.

In this way, shaping can be performed without causing flaws due to the plastic film 3 at the time of the second step of processing. Even in a product with a high degree of shaping, it is possible to fabricate large quantities inexpensively by using a precoated steel sheet as the material and shaping flaw-free products by a die.

INDUSTRIAL APPLICABILITY

As explained above, the present invention provides a method and apparatus for painting the cut edge (or end edge)

of a precoated steel sheet or the processed article thereof wherein the cut edge can be painted in a manner facilitating automatic painting, at a low cost, at a high efficiency, with a high quality, giving a thickness of several tens of microns, and capable of obtaining local painting of a uniform thickness. Due to this, it is possible to improve the rust-proofing performance of the product using the precoated steel sheet and greatly expand the applications of precoated steel sheet products which are beautiful, low cost, and superior in recycling ability. The invention is consequently high in industrial value.

We claim:

1. A method for painting a cut edge of a precoated steel sheet or the processed article thereof, to which a masking film is attached, comprising impregnating a painting pad composed of a sponge or a nonwoven and/or woven fabric with a paint, followed by wiping the surface of the painting pad with a gas to remove the excess paint on or in the painting pad, then pressing the painting pad against the cut edge of the precoated steel sheet under force control to provide a coating of paint to the cut edge.

2. A method for painting a cut edge according to claim 1, wherein, when pressing the painting pad against the cut edge under the force control, at least two settings of the pressing force are provided and in the final painting step of the pressing process just before painting pad is pulled away from the cut edge of the precoated steel sheet, the painting pad is pressed for a predetermined time by a setting of the pressing force smaller than the maximum pressing force.

3. A method for painting a cut edge according to claim 1, wherein, when pressing the painting pad against the cut edge under the force control, the painting pad is pressed from a direction inclined by an inclination $\tan\theta = 1/100$ to $1/3$ from the direction perpendicular to the cut edge.

4. A method for painting a cut edge according to claim 1, wherein, after coating the paint to the cut edge of the precoated steel sheet by the painting pad and before drying or curing the coated paint, the paint coated on the cut edge is allowed to reflow with hot air to thereby smooth the paint coated on the cut edge.

5. A method for painting a cut edge according to claim 1, wherein the painting pad has a width necessary for several steps of pressing and painting, and the pressing and painting are performed several times while successively changing the position in the width direction of the painting pad with each application of paint to the painting pad.

6. A method for painting a cut edge according to claim 1, wherein the precoated steel sheet is shaped or cut in a state where a plastic film is attached to at least the surface of the precoated steel sheet becoming the outer surface of the shaped article, while using the attached plastic film as a masking film.

7. A method for painting a cut edge according to claim 6, wherein the plastic film attached to the surface of the precoated steel sheet is predivided and/or has a cut or perforations therein so as to allow the plastic film of the cutting and painting portion to be separated from the other portion of the plastic film and left.

8. A method for painting a cut edge according to claim 6, wherein, after the precoated steel sheet is shaped into the shape of the final product and before cutting the cut portion to finally remain in the product, the local stress occurring in the attached plastic film at the time of shaping is relaxed by heating or partial cuts in the plastic film.

9. A method for painting a cut edge according to claim 6, the plastic film is attached to the surface of the precoated steel sheet only near the painting portion of the cut edge.

10. A method for painting a cut edge according to claim 6, wherein the plastic film is attached to the cut portion, which finally remain in the product shaped from the precoated steel sheet, before cutting, instead of the application of the plastic film to the precoated steel after cutting but before shaping the precoated steel, so that the plastic film is attached only near the painting portion of the cut edge.

11. A method for painting a cut edge according to claim 6, wherein, in the state having the plastic film attached thereto, the precoated steel sheet is shaped while heated to at least the softening temperature of the plastic film so as to prevent flaws in the coating.

12. A method for painting a cut edge according to claim 1, wherein said paint is a ultraviolet (UV) curing paint.

13. A method for painting a cut edge according to claim 12, wherein said UV curing paint contains a coloring pigment.

14. A method for painting a cut edge according to claim 13, wherein 2% by weight or less of a coloring pigment is contained in the paint.

15. A method for painting a cut edge according to claim 1, wherein said paint is an ordinary temperature curing paint.

16. A method for painting a cut edge according to claim 15, wherein the viscosity of the ordinary temperature curing paint is 500 to 2500 cps.

17. A method for painting a cut edge according to claim 16, wherein 2% by weight or less of a black pigment is contained in the paint.

18. A method for painting a cut edge according to claim 16, wherein the gloss of the coating is 70% or less.

19. A painting apparatus for painting the cut edge of a precoated steel sheet or the processed article thereof to which a masking film is attached, comprising a painting pad composed of a sponge or a nonwoven and/or woven fabric, a mechanism for impregnating the painting pad with a paint and/or for pressure feeding and soaking a paint to the inside surface of the painting pad, a mechanism for wiping the excess paint on or in the surface of the painting pad with a gas, and a mechanism for pressing the painting pad against the cut edge under force control.

20. A painting apparatus according to claim 19, wherein the painting pad is composed of a nonwoven fabric at the inside, a woven fabric which covers the outside of the nonwoven fabric at least at the surface coming into contact with the cut edge of the precoated steel sheet or the shaped article thereof, and a rigid base to which the nonwoven fabric and the woven fabric are attached.

21. A painting apparatus according to claim 20, wherein the tension of the woven fabric at the outside of the painting pad is made adjustable by a screw.

22. A painting apparatus according to claim 19, wherein the mechanism for pressing the painting pad against the cut edge is made a pressing mechanism using a fluid pressure cylinder and the circuit of the fluid pressure cylinder is provided with a multistep pressure setting circuit capable of controlling the force pressing the painting pad during the pressing and painting.

23. A painting apparatus according to claim 19, wherein the mechanism for pressing the painting pad against the cut edge of the precoated steel sheet is made a pressing mechanism using a mechanical spring mechanism composed of several stages connected in parallel and/or in series and the mechanical spring mechanism has a mechanism for changing the spring force in several stages by successively releasing the constraint of the spring force or reconstraining the same depending upon the stroke of movement between the painting pad and the holding device so as to thereby make the force pressing to the painting pad during the pressing and painting variable.

24. A painting apparatus according to claim 19, wherein the mechanism for pressing the painting pad against the cut edge of the precoated steel sheet is made a combination of a pressing mechanism using a fluid pressure cylinder, wherein the circuit of the fluid pressure cylinder is provided with a multistep pressure setting circuit capable of controlling the force pressing the painting pad during the pressing and painting, and a pressing mechanism using a mechanical spring mechanism, wherein the spring mechanism is composed of several stages connected in parallel and/or in series and the mechanical spring mechanism has a mechanism for changing the spring force in several stages by successively releasing the constraint of the spring force or reconstraining the same depending upon the stroke of movement between the painting pad and the holding device so as to thereby make the force pressing to the painting pad during the pressing and painting variable.

25. A painting apparatus according to any one of claim 19, wherein the painting pad is made a rotatable construction and the rotation of the painting pad is constrained by a mechanical stopper when retracting the pressing mechanism.

* * * * *

UNITED STATES PATENT AND TRADEMARK OFFICE

CERTIFICATE OF CORRECTION

PATENT NO. : 5,891,521
DATED : April 6, 1999
INVENTOR(S) : Seiichi MARUMOTO, et al.

It is certified that error appears in the above-indentified patent and that said Letters Patent is hereby corrected as shown below:

Column 2, line 58, change "sheet" to --sheets--.

Column 2, line 59, change "have" to --has--.

Column 15, line 49, after "whereby" insert --the--.

Column 21, line 35, "2500 cps." should end paragraph and insert --Example 6-- as a heading before paragraph starting "In this Example".

Column 24, line 14, change "a ultraviolet" to --an ultraviolet--.

Signed and Sealed this

Fifteenth Day of February, 2000

*Attest:*

*Attesting Officer*

Q. TODD DICKINSON

*Commissioner of Patents and Trademarks*